US006978581B1

(12) United States Patent
Spakousky

(10) Patent No.: US 6,978,581 B1
(45) Date of Patent: Dec. 27, 2005

(54) COMPOSITE BUILDING BLOCK WITH CONNECTIVE STRUCTURE

(75) Inventor: John G. Spakousky, Maple Grove, MN (US)

(73) Assignee: Pentstar Corporation, Minneapolis, MN (US)

( * ) Notice: Subject to any disclaimer, the term of this patent is extended or adjusted under 35 U.S.C. 154(b) by 0 days.

(21) Appl. No.: 09/390,435

(22) Filed: Sep. 7, 1999

Related U.S. Application Data

(63) Continuation-in-part of application No. 08/795,691, filed on Feb. 4, 1997, now Pat. No. 5,983,585.

(51) Int. Cl.[7] ..... E04B 2/32; E04B 1/78

(52) U.S. Cl. ..... 52/405.4; 52/405.1; 52/424; 52/426; 52/431; 52/565

(58) Field of Search ..... 52/405.4, 424, 52/426, 425, 596, 564, 563, 589.1, 309.11, 606, 565, 378, 379, 405.1, 427, 590.1, 590.2, 431; 405/35, 284; 312/265.5

(56) References Cited

U.S. PATENT DOCUMENTS 510,720 A * 12/1893 Stewart, Jr. ..... 52/426
994,027 A 5/1911 O'Beirne (Continued)

FOREIGN PATENT DOCUMENTS

FR 730009 * 8/1932 ..... 52/426
FR 1075695 * 10/1954 ..... 52/425

*Primary Examiner*—Phi Dieu Tran A
(74) *Attorney, Agent, or Firm*—Dorsey & Whitney LLP

(57) ABSTRACT

A composite building block with a connective structure between the inner and outer wall units is presented. The wall units can be made of cement, clay brick, or similar materials. The connective structure is made of a material different than the wall units and may be integrally formed per the requirements of a particular wall construction project. In one embodiment, the connective structure comprises a center form, and one or more arms have connectors that connect to corresponding connectors integrally formed on the wall units. The center form may partition the cavity between the inner and outer wall units into two or more cavities, which may then be partially filled with, for example, insulative material or load-bearing materials, such as concrete.

20 Claims, 27 Drawing Sheets

U.S. PATENT DOCUMENTS 1,226,214 A * 5/1917 Hopkins ..... 52/424
1,345,156 A * 6/1920 Flynn ..... 52/426
1,444,554 A * 2/1923 Quillet ..... 52/606
1,546,658 A 7/1925 Harter
1,567,430 A 12/1925 Eberling
1,624,369 A * 4/1927 Serra ..... 52/426
1,962,906 A * 6/1934 Mueller ..... 52/426
2,134,894 A 11/1938 Schubert
2,172,052 A 9/1939 Robbins
2,326,361 A 8/1943 Jacobsen
2,647,392 A 8/1953 Wilson
3,593,480 A 7/1971 Bouchillon
4,180,956 A 1/1980 Gross
4,263,765 A * 4/1981 Maloney ..... 52/562
4,348,847 A * 9/1982 Jukes ..... 52/426
4,380,887 A 4/1983 Lee
4,498,266 A 2/1985 Perreton
4,703,602 A 11/1987 Pardo
4,731,968 A * 3/1988 Obino ..... 52/309.12
4,742,659 A * 5/1988 Meilleur ..... 52/309.12
4,745,720 A 5/1988 Taylor
4,802,318 A 2/1989 Snitovski
4,841,707 A 6/1989 Novoa
4,866,891 A * 9/1989 Young ..... 52/105
4,884,382 A * 12/1989 Horobin ..... 52/426
4,967,528 A 11/1990 Doran
4,982,544 A * 1/1991 Smith ..... 52/606
5,086,600 A * 2/1992 Holland et al. ..... 52/594
5,193,318 A * 3/1993 Antonio et al. ..... 52/144
5,209,037 A 5/1993 Kennedy et al.
5,321,926 A 6/1994 Kennedy
5,337,530 A 8/1994 Beames
5,379,565 A 1/1995 Vienne
5,459,970 A * 10/1995 Kim ..... 52/424
5,465,545 A * 11/1995 Trousilek ..... 52/425
5,560,167 A 10/1996 Miceli
5,570,552 A 11/1996 Nehring
5,657,600 A 8/1997 Mensen
5,658,483 A * 8/1997 Boeshart ..... 249/191
5,704,180 A * 1/1998 Boeck ..... 52/426
5,709,060 A * 1/1998 Vaughan et al. ..... 52/426
5,709,061 A 1/1998 Dietrich
5,782,050 A * 7/1998 Boeshart ..... 52/426
5,809,728 A * 9/1998 Tremelling ..... 52/426
5,845,448 A 12/1998 Potvin
5,896,714 A * 4/1999 Cymbala et al. ..... 52/426
5,983,585 A 11/1999 Spakousky
6,170,220 B1 1/2001 Moore, Jr.
6,176,059 B1 * 1/2001 Cantarano et al. ..... 52/578

* cited by examiner

COMPOSITE BUILDING BLOCK WITH CONNECTIVE STRUCTURE

This application is a continuation-in-part of U.S. patent application Ser. No. 08/795,691 filed Feb. 4, 1997, entitled "Building Block With Insulating Center Portion," which issued on Nov. 16, 1999 as U.S. Pat. No. 5,983,585.

I. FIELD

This invention relates to building blocks and more particularly, but not by way of limitation, to composite building blocks made with a connective structure extending between the inner and outer walls of the building block.

II. BACKGROUND

Building blocks have developed over time. Originally, solid bricks were used. These evolved into cinder blocks. These blocks are formed of concrete and have a pair of holes formed through the blocks. A typical cinder block is shown in FIG. 1 of U.S. Pat. No. 1,567,430 to Eberling. Another type of cinder block is shown in FIG. 1 of U.S. Pat. No. 2,172,052 to Robbins. The holes in the cinder blocks make the blocks considerably lighter, can be used as a better handle to help carry and position the blocks, can be used as a space within the blocks to hold reinforcing bars, and can be filled with concrete once the blocks are placed.

The basic cinder block has changed little over time. However, new blocks have been developed to make construction more flexible. For example, in U.S. Pat. No. 4,982,544 to Smith, there are disclosed precast concrete modules for use in constructing load-bearing retaining walls—i.e., walls capable of supporting large vertical loads. The Smith precast concrete modules comprise a plurality of face walls and integrally formed connecting walls configured to form cavities in the modules. When the Smith precast concrete modules are assembled into a load-bearing wall, concrete may be poured into each cavity to finally form the load-bearing wall.

A number of blocks were developed to better insulate block walls. A normal cinder block that is filled with cement has no space for insulating material. Although the blocks do provide some insulating properties, such blocks are best known as heat absorbers. Thus, a block wall absorbs heat in the summer and holds that heat, which causes an increased cooling load. Similarly, in winter, they absorb cold, increasing the heating load. To solve this problem, several blocks have been developed to allow for insulative material to be placed within the blocks, thereby breaking the thermal flow paths. Examples of these blocks are found in the following U.S. patents. U.S. Pat. No. 3,593,480 teaches a block that has an outer appearance that is similar to an ordinary cinder block. The block is actually a plastic shell that has cavities that are filled with concrete. The block also has open areas that can be either dead air space or can be filled with insulating material. The problem with these blocks is that they must be filled with concrete, and the concrete must be cured, before they can be set into place. Once filled, these blocks become heavy and are difficult to work with.

U.S. Pat. No. 4,380,887 to Lee teaches a cinder block that is made with special slots that allow foam insulation to be inserted into the slots. The idea is to break up the thermal conductivity through the block webs. Although this design is an improvement, it still requires a full size block, with all the weight problems associated with that. Moreover, the insulating panels are designed to be inserted from both the top and the bottom of the block. This slows down the construction process, if the blocks are insulated in the field. It adds to the cost of installation if the insulation is added at the factory.

U.S. Pat. No. 4,498,266 to Perreton teaches a cinder block that has a center channel to hold blocks of insulation. U.S. Pat. No. 4,745,720 to Taylor teaches a cinder block that is cut in two lengthwise. The split block is then reassembled with a special insulating channel in the center. Special clips are provided to secure the insulation within the block. U.S. Pat. Nos. 5,209,037 and 5,321,926 teach cinder blocks that have complex curves formed in them to receive insulation. Although these blocks provide improved insulating capabilities, the complex curved design increases cost and provides minimal hand holds for block placement. This makes construction more difficult and slow, which also drives up cost.

U.S. Pat. No. 4,841,707 to Nova teaches an alternative direction in block wall construction. As noted above, the problem with ordinary blocks is the transmission of cold and heat through the blocks themselves. The blocks above seek to break the transmission path. Another way to do this is to use a double wall. Such a wall has the outward appearance of an ordinary block wall, but has an outer block wall and an inner block wall that are connected by bracing. The space between the walls can be filled with insulating material to provide the best possible levels of insulation. The problem with the Nova wall is that there are no discrete blocks. Both walls are poured. Although this is an acceptable building method, it can be expensive, especially for residential type construction.

Finally, in U.S. Pat. No. 4,180,956 to Gross, there is disclosed a cavity wall structure comprising hollow panel units 2 interconnected by ties 13, and enclosing insulating elements 11. The Gross wall structure, however, appears to have limited applicability in the construction of load-bearing walls. Gross FIG. 1 shows wall panel units 2 to be much thinner than insulating elements 11. The Gross wall panel units 2 thus appear unsuited for supporting heavy loads, and it is not clear how they would conform to conventional U.S. building code structural requirements because of their relative thinness. Furthermore, components of the Gross wall structure are interconnected with ties 13 located at panel unit edges that not only tie together opposed inner and outer walls but link adjacent wall unit edges. This makes the Gross wall system inapplicable in wall construction projects where construction personnel are trained in building walls by laying discrete blocks with mortar interconnections. A person building one of Gross' walls would need to deal with several separate panel units 2 (adjacent as well as opposed) and ties 13 that would have to be assembled at the same time as the stacking of the insulating elements 11. It is not clear that one person working alone could easily perform this assembly.

III. SUMMARY

The present invention involves a discrete, composite block construction. The inner and outer walls of a block unit are separately formed. At least one of the inner and outer walls may be cement, clay brick, stone or other masonry type material having a good vertical load-bearing capacity. Connected to the at least one wall and extending between the inner and outer walls is a connective structure. This connective structure is lattice-like and made of plastic or other formable material that can readily be formed into thinner and more complexly shaped structures than cement, clay brick, stone or other masonry materials, due to its flowability characteristics during forming and its greater tensile and/or shear strength after forming. The qualities of the material used in the connective structure, as well as its shape and configuration, permit a variety of new advantages to be achieved in block wall construction. The inner and outer walls are joined with the connective structure to form a discrete block unit before the composite block is placed in a wall.

In one embodiment, the instant invention uses a block type construction that has two cement panels, concrete walls, or clay brick walls, joined by a connective structure, such as a plastic web. This composite block then has the strength of a conventional cinder block—i.e., it has load-bearing properties that are characteristic of a conventional cinder block—but with much less weight. Moreover, the plastic webs provide a handle to permit easy handling and placement of the blocks. Because of the thermal characteristics of these plastic webs, when a wall is finished using these blocks, it can have the insulation characteristics of a true double wall construction. The blocks may be filled with concrete on one side of a center form in the web and filled with insulation on the other side. This provides a structurally sound wall that is well-insulated. The blocks can be full height or half height size and also come in corner configurations.

One or more of the following advantages can be achieved with the present invention: a building block system that is well-insulated and provides a reduced thermal path from the outside of the wall to the inside of the wall; a building block that is lightweight and easy to install in the field; a building block system that has full structural integrity and yet can be well-insulated; a building block system for use in the construction of load-bearing walls; and a building block system where composite blocks may be easily configured or reconfigured for the requirements of a particular building project.

IV. BRIEF DESCRIPTION OF THE DRAWINGS

FIG. 1 is a top view of the first embodiment of the invention.

FIG. 1*a* is a top view of the half height embodiment of the invention.

FIG. 15*a–d* are perspective, plan, side and end views, respectively of an alternative embodiment.

Figure 16B:
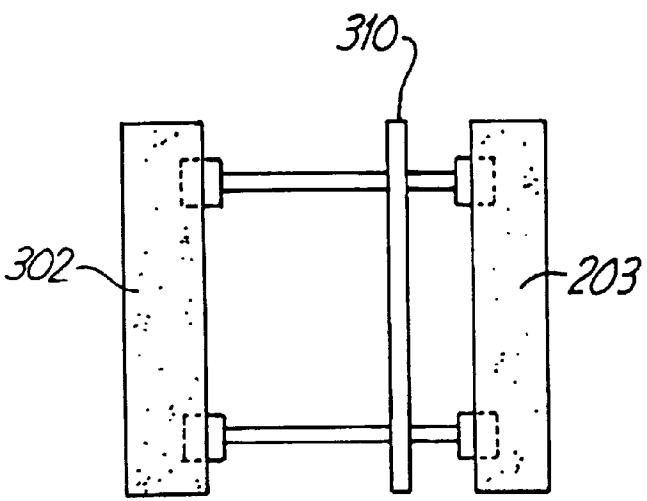
Figure 16A:
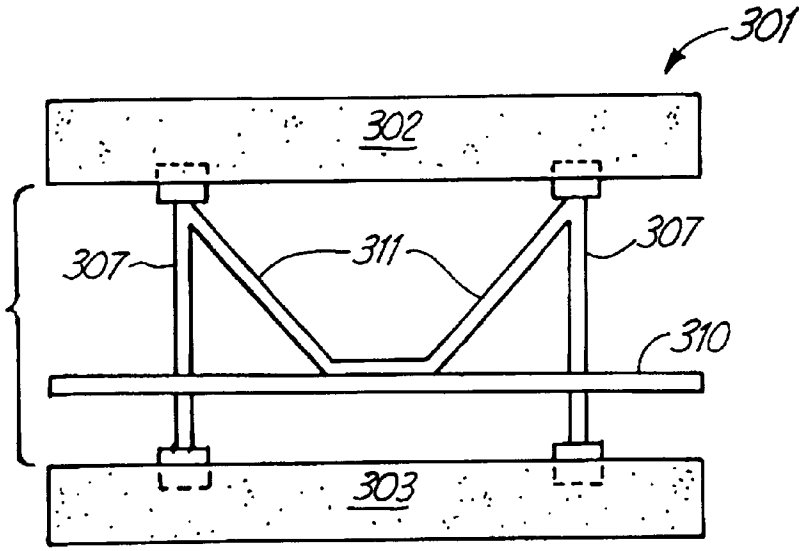

FIGS. 16*a–b* are plan and end views of yet another alternative embodiment.

Figure 17B:
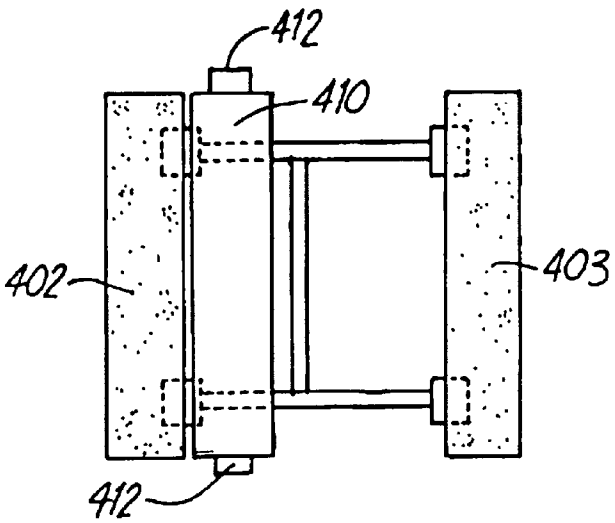
Figure 17A:
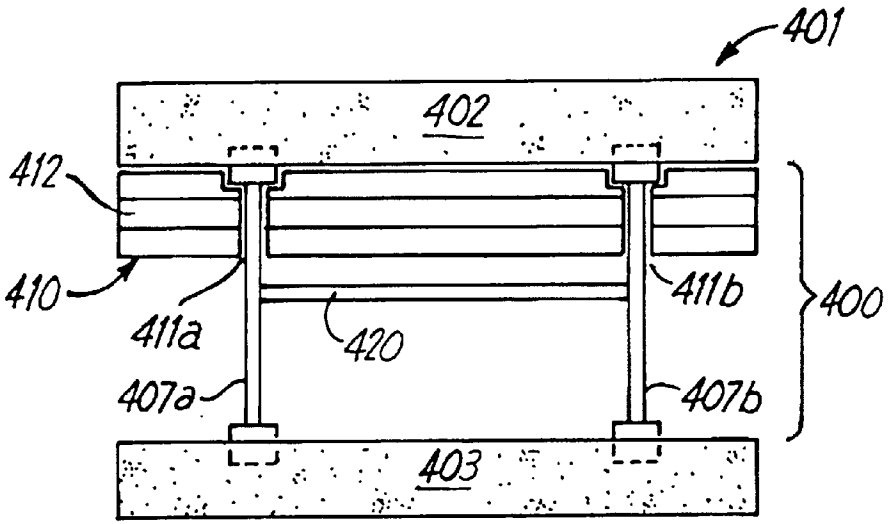

FIGS. 17*a–b* are plan and end views of yet another alternative embodiment.

Figure 18B:
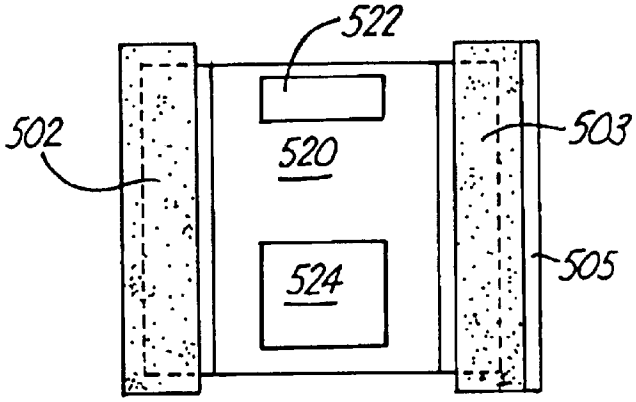
Figure 18A:
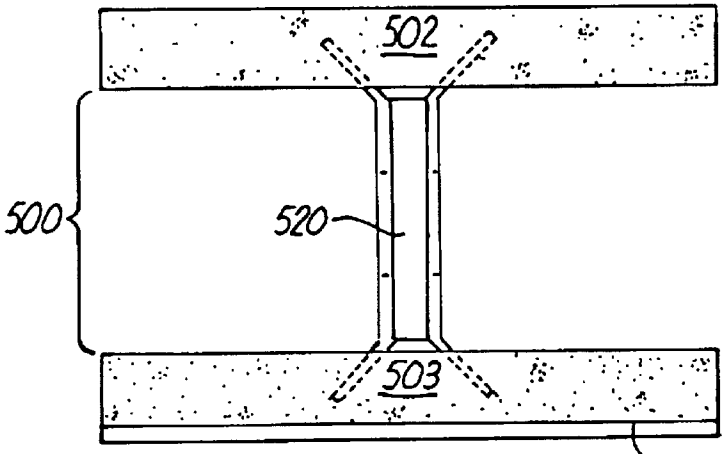

FIGS. 18*a–b* are plan and end views of yet another alternative embodiment.

Figure 19B:
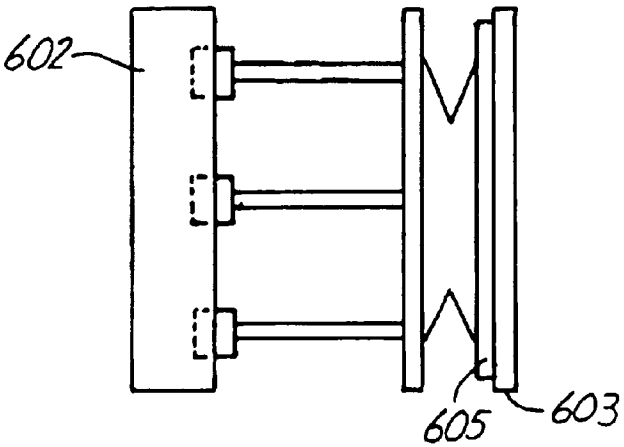
Figure 19A:
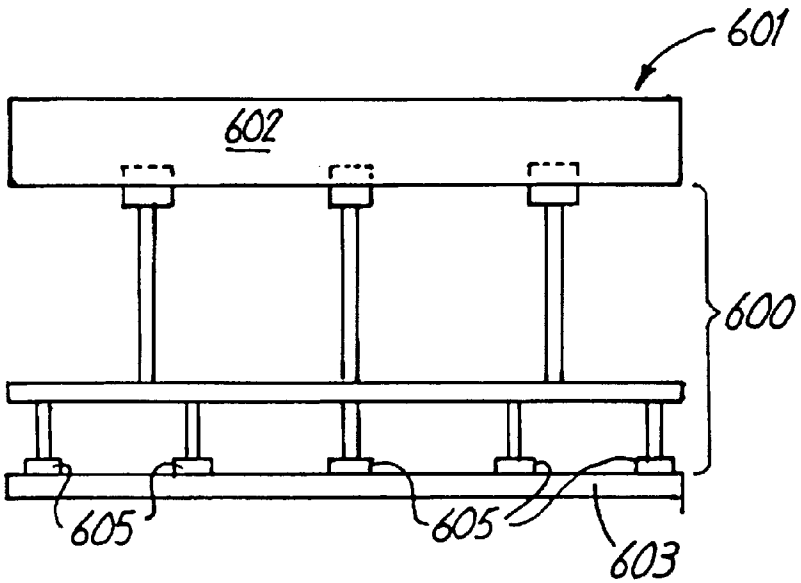

FIGS. 19*a–b* are plan and end views of yet another alternative embodiment.

Figure 20B:
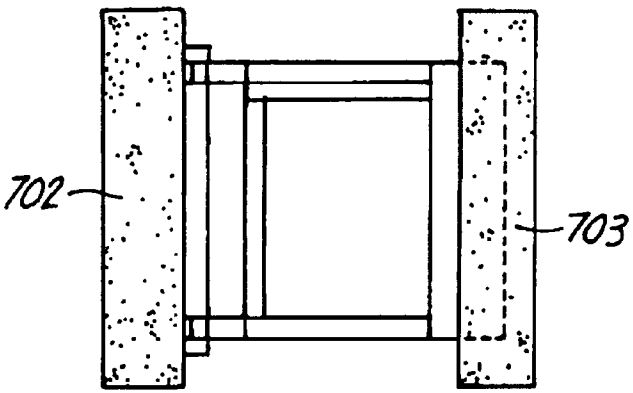
Figure 20A:
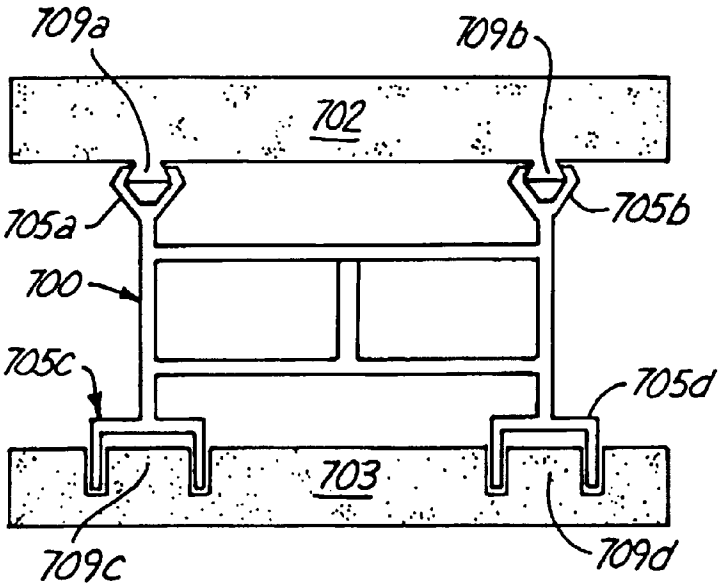

FIGS. 20*a–b* are plan and end views of yet another alternative embodiment.

Figure 21B:
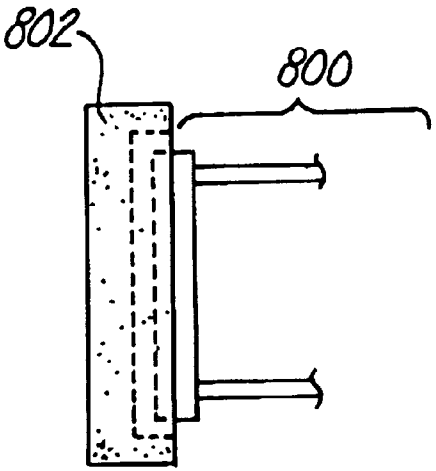
Figure 21A:
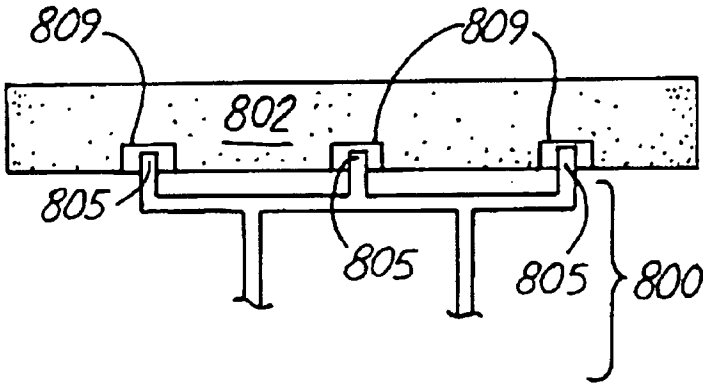

FIGS. 21*a–b* are plan and end views of one wall and a portion of the connective structure of yet another alternative embodiment.

Figure 22C:
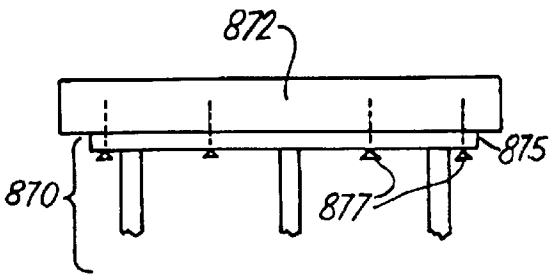
Figure 22B:
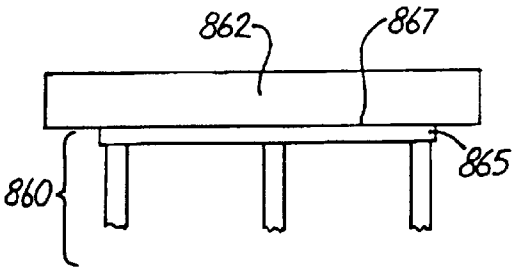
Figure 22A:
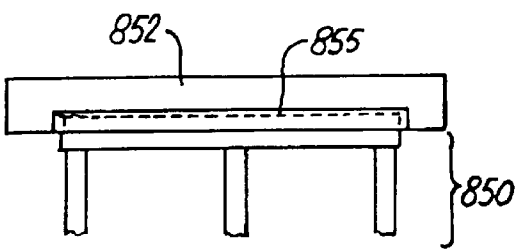

FIGS. 22*a–c* are plan views of one wall and a portion of the connective structure of yet another alternative embodiment.

Figure 23A:
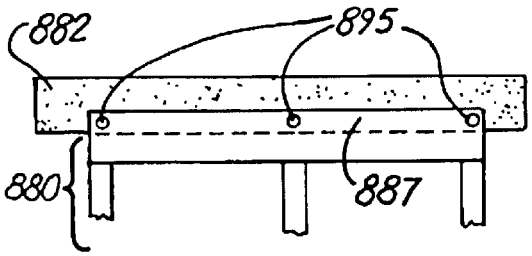
Figure 23B:
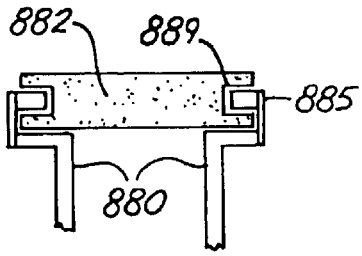

FIGS. 23*a–b* are plan and end views of one wall and a portion of the connective structure of yet another alternative embodiment.

Figure 24A:
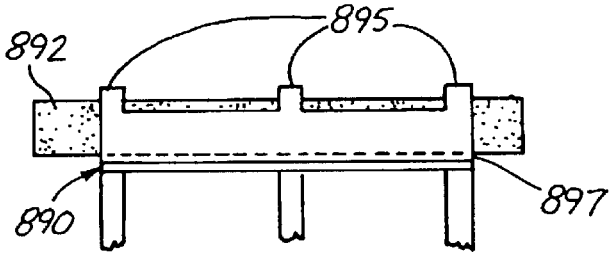
Figure 24B:
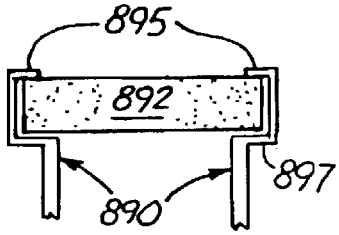

FIGS. 24*a–b* are plan and end views of one wall and a portion of the connective structure of yet another alternative embodiment.

Figure 25A:
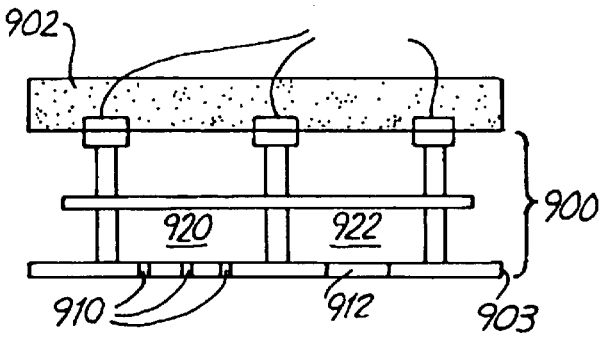
Figure 25B:
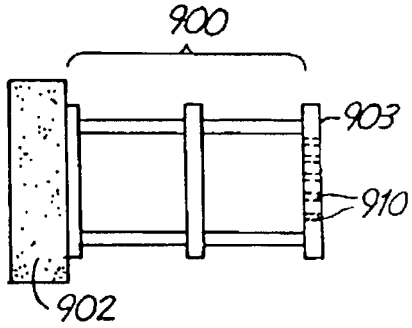

FIGS. 25*a–b* are plan and end views of a yet another alternative embodiment.

Figure 26A:
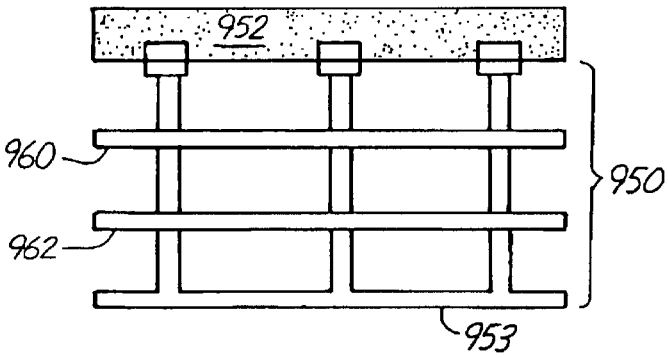
Figure 26B:
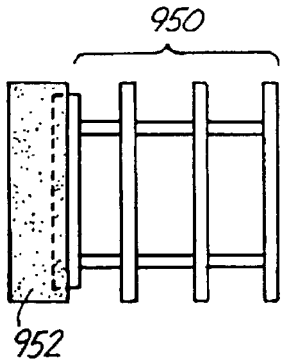

FIGS. 26*a–b* are plan and end views of a yet another alternative embodiment.

V. DETAILED DESCRIPTION

A. General Description

Figure 1:
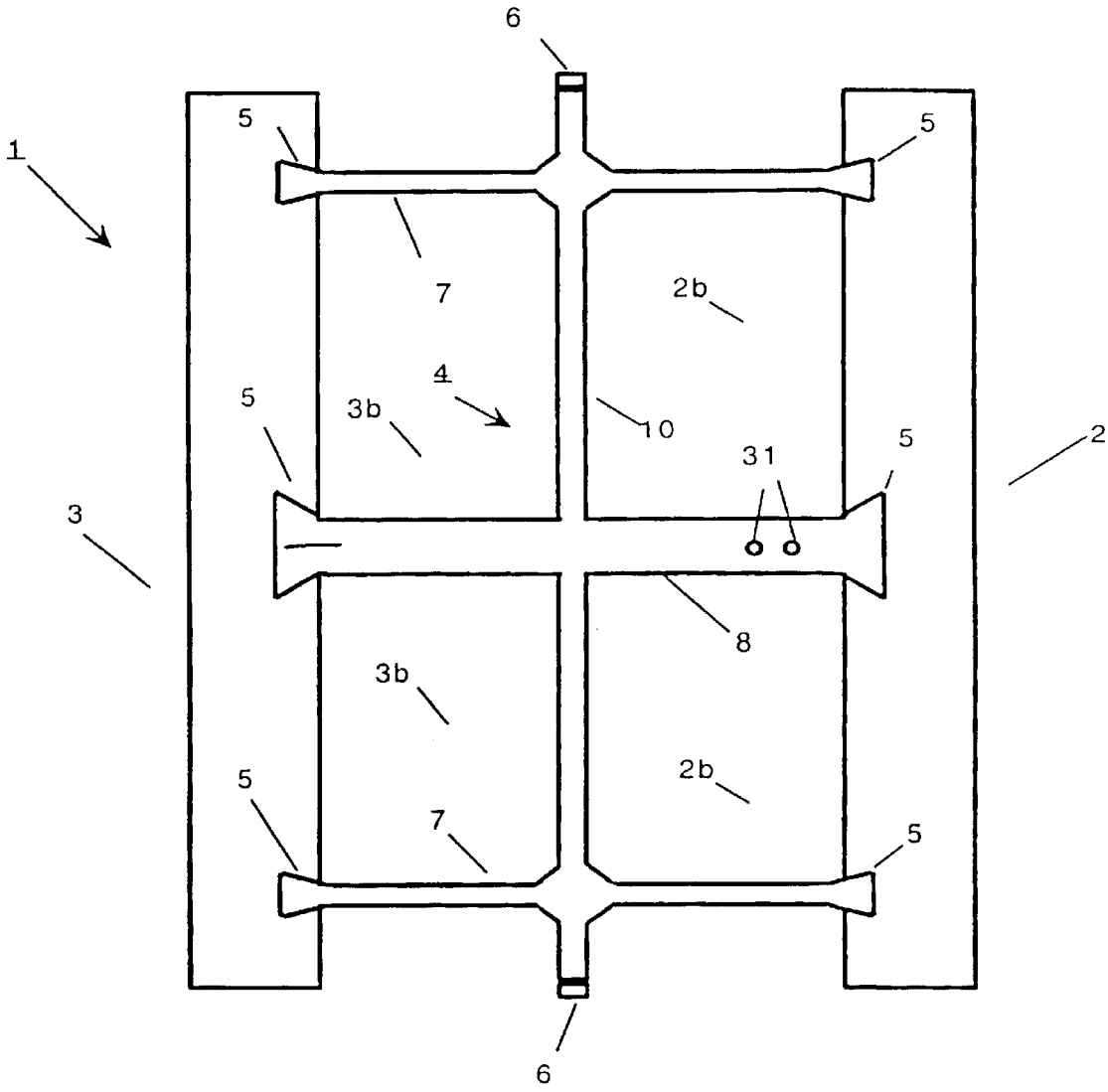
Figure 2:
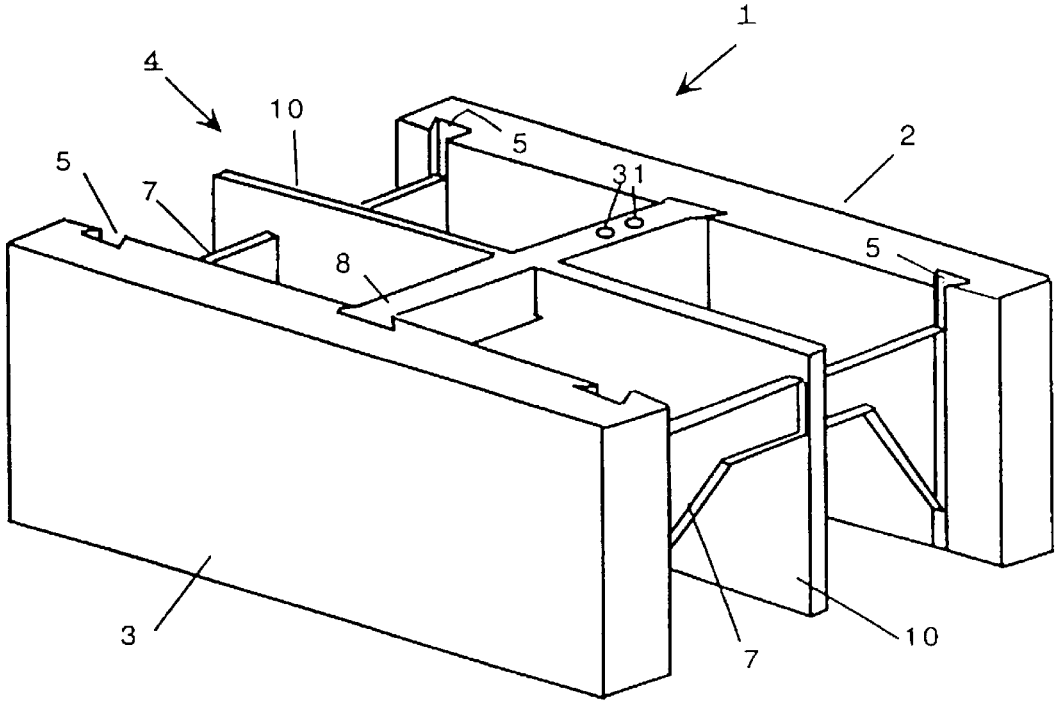
FIG. 2 is a perspective view of the first embodiment of the invention.

Referring now to FIG. 1, the top view of one embodiment of the present invention is shown. FIG. 2 is a perspective view of this embodiment. This block 1 has an outer wall 2, an inner wall 3 and a center plastic web 4. The outer wall 2 and the inner wall 3 can be made from cement, clay brick or similar materials. Other suitable materials are natural or man-made store, plastic, wood and ceramic materials. The outer wall 2, and inner wall 3 may have identical forms, although this is not required. The web 4 has two end arms 7 and a center arm 8 as shown. The center arm 8 and end arms 7 are connected to a center form 10. These parts of the web 4 form an integral unit, and operate as connective structure to connect and rigidly secure outer wall 2 and inner wall 3 together. As FIG. 1 shows, the central arm 8 may be considerably thicker than the outer arms 7.

The inner and outer walls have a number of dovetail shaped grooves 5 to receive and hold the plastic web 4. In the embodiment shown, three grooves 5 are used. Soft foam gaskets 6 or other similar structures are used to seal the plastic joints by filling the gaps created by mortar joints between the units (see, e.g., FIGS. 7 and 8).

With the web 4 in place, it can be seen that two cavities are formed by the outer wall 2, the center form 10, and the inner wall 3. The space between the outer wall 2 and the central form 10 is the outer cavity 2*b* and the space between the inner wall 3 and the central form 10 is the inner cavity 3*b*.

Figure 1A:
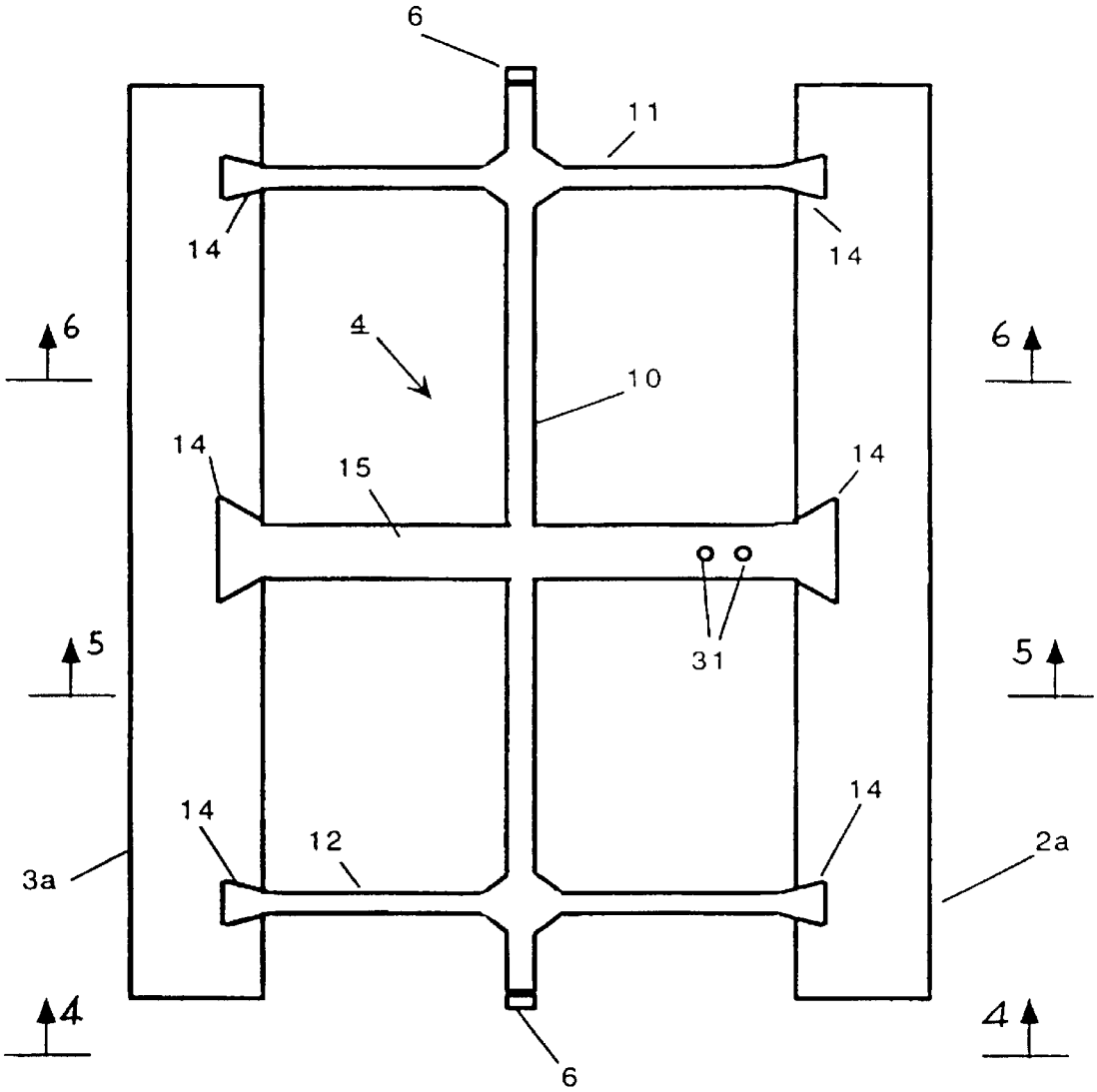
Figure 5:
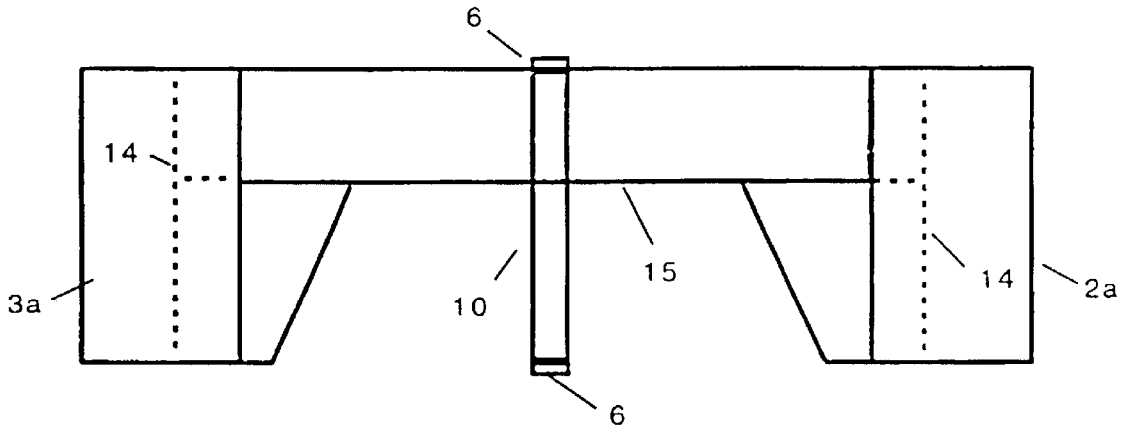
FIG. 5 is a detailed cross-sectional view of a half-height block taken along the lines 5—5 of FIG. 1*a*.
Figure 6:
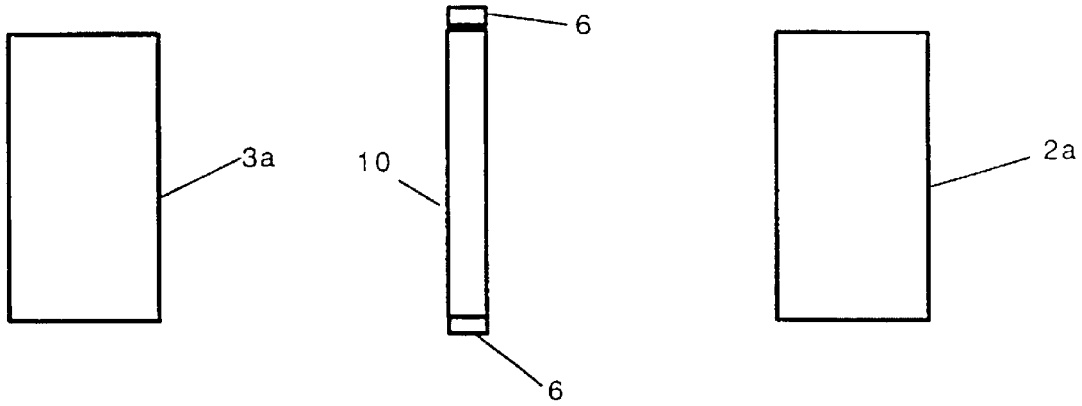
FIG. 6 is a detailed cross-sectional view of a half-height block taken along the lines 6—6 of FIG. 1*a*.
Figure 7:
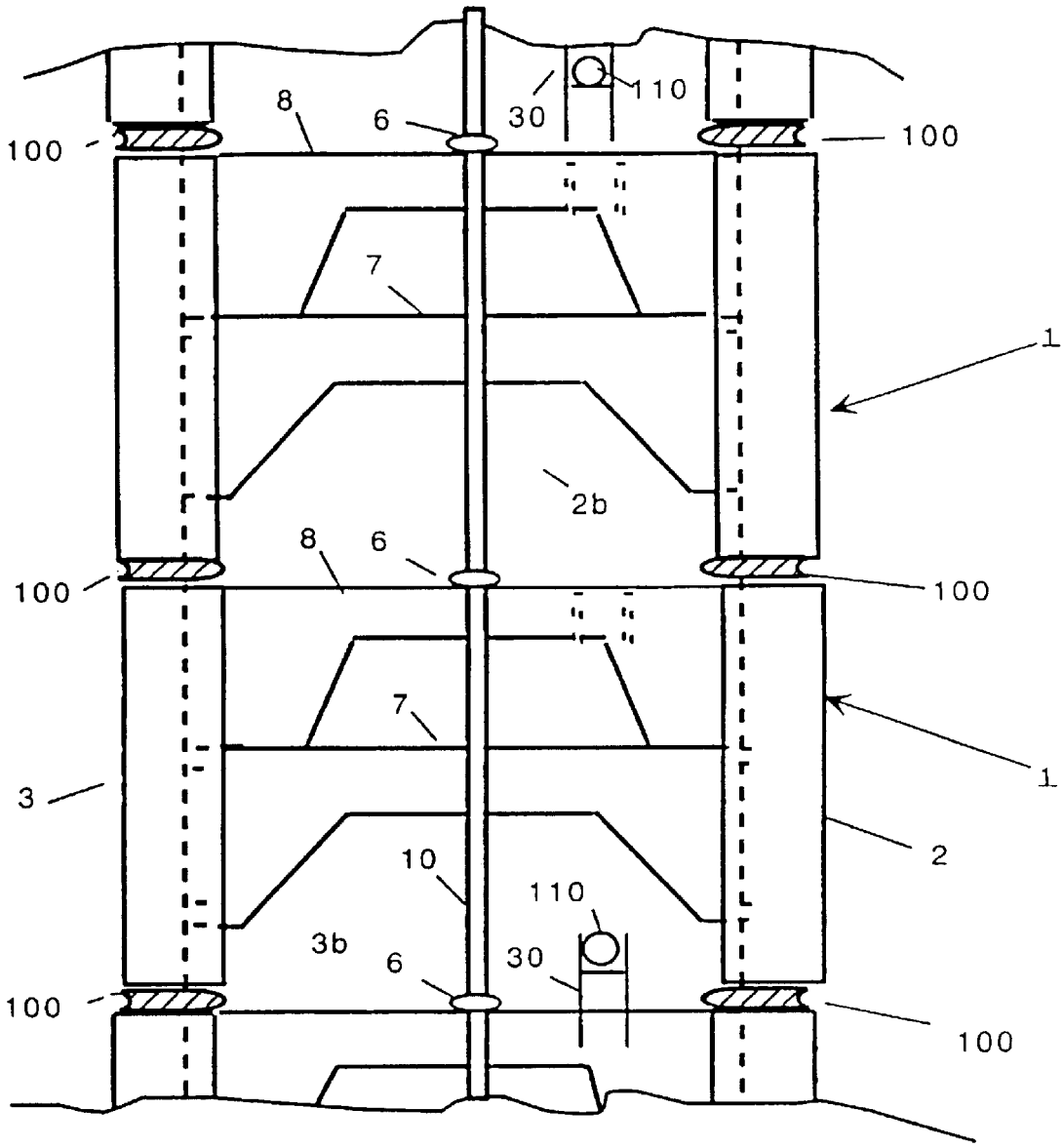
FIG. 7 is a side detail view of a number of blocks of the first embodiment, stacked to form a wall.

FIG. 1*a* is a top view of another embodiment of the present invention—a half-height version. FIGS. 5, 6 and 7 are sectional views of the half-height embodiment. One difference between this embodiment and the embodiment of FIG. 1 is the height of the wall. The half-height units may be particularly useful in clay brick walls to maintain a typically brick wall appearance.

The half-height blocks have an outer wall 2*a* and an inner wall 3*a* as shown. The plastic web 4 has a center form 10 as shown. Two end arms 11 and 12 extend outward from the center form 10 as shown. These arms 11 and 12 have corresponding dovetail shaped projections 14 as shown. A center arm 15 is also used.

Figure 3:
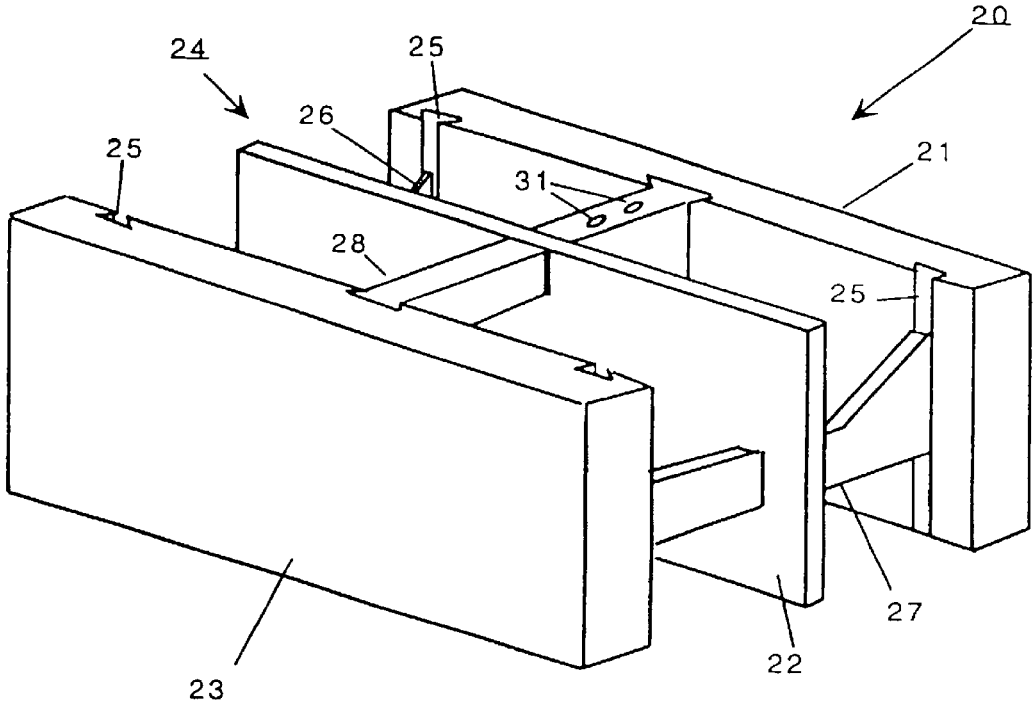
FIG. 3 is a perspective view of the second embodiment of the invention.

FIG. 3 is a perspective view of yet another embodiment. This embodiment 20 also has an outer wall 21, an inner wall 23 and a plastic web 24. As in the case of the embodiment of FIG. 1, both the outer wall 21 and inner wall 23 may have identical forms. Each wall has a number of dovetail shaped grooves 25 to receive and hold the plastic web 24. In this embodiment, three grooves are also used, as shown. The web 24 has a center form 22 as shown. The end arms 26 and 27 have flat bottoms and angled tops as shown. The end arms 26 and 27 and a center arm 28 are also provided as shown. All the arms are connected to the center form 22. Note that in the embodiment of FIG. 1, the two end arms 11 and 12 have a lower angled portion and flat tops. Alternatively, in this embodiment, the end arms have flat bottoms and angled tops.

In all the embodiments, the center arm (8, 15 or 28) may be used as a handle for the blocks. When this is true, the center arms (8, 15 or 28) may have flat tops and are flush with the top surface of the inner and outer walls. This allows a worker to easily pick up and place the blocks by gripping the center arm.

Figure 4:
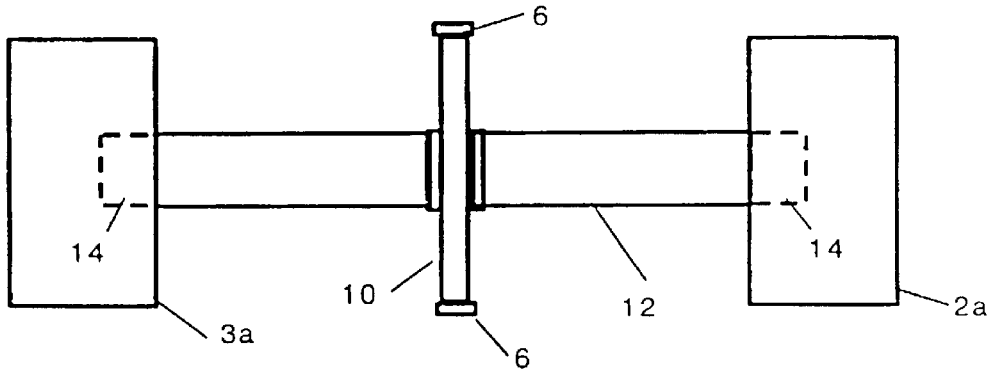
FIG. 4 is a detailed cross-sectional view of a half-height block taken along the lines 4—4 of FIG. 1*a*.

Referring now to FIGS. 4, 5 and 6, details of the half-height blocks are shown. FIG. 4 is a cross section of a half-height block taken through the block showing an end arm. FIG. 5 is a cross section of the half-height block showing the center arm 15. FIG. 6 is a cross section of the half-height showing the center portion of the web 4.

Figure 8:
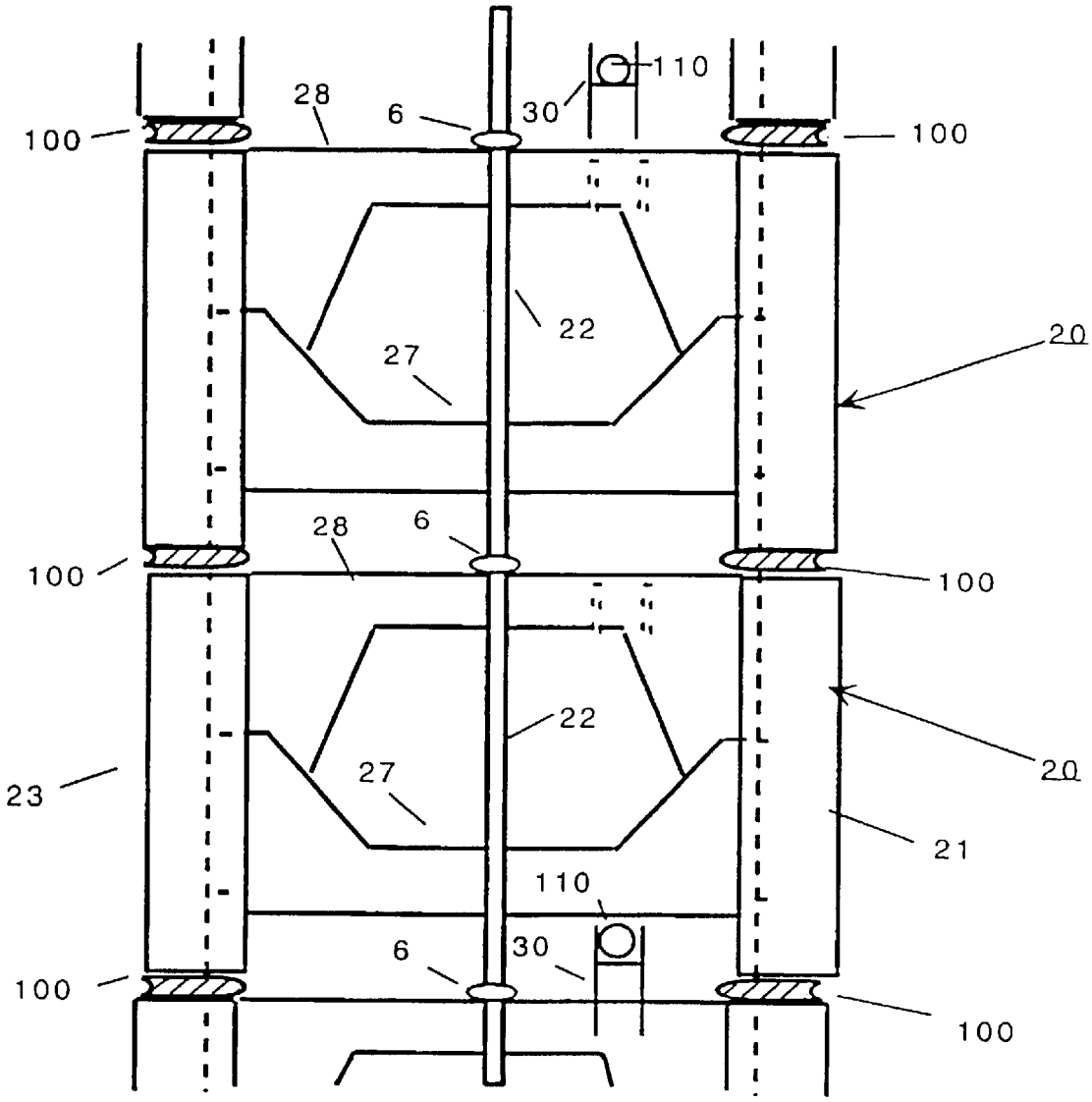
FIG. 8 is a side detail view of a number of blocks of the second embodiment, stacked to form a wall.

Referring now to FIGS. 7 and 8, details of a typical block wall assembly constructed according to the present invention are shown. FIG. 7 is a side view of a section of wall formed by the blocks 1 of the embodiment of FIG. 1. The blocks 1 may be stacked as shown. Mortar 100 is applied to the outer and inner walls to form a tight joint between the blocks 1 as shown. Foam gaskets 6 or other types of sealer are applied to the center forms 10 of the webs 4. These gaskets effectively seal the gap between the webs 4 of the blocks 1.

Once the blocks are set in place, a structure of reinforcing bars (rebar) 110 may be placed in the outer cavity 2*b* (although, one could just as easily place them in the inner cavity 3*b*). The rebar is set on wire supports 30 that are placed in holes 31 formed in the center arm. See FIGS. 1, 7 and 8. Once the rebar 110 is in place, the outer cavity 2*b* of the block can then be filled with concrete to make a solid wall structure. The inner cavity 3*b* of the block 1 may be filled with insulation. In this way, the blocks 1 form a solid double wall structure that is fully insulated.

FIG. 8 shows a wall segment made up of blocks 1 using a different connective structure than that shown in FIG. 7. It is assembled in a similar manner. Except for the different connective structure, there is no difference in assembling a wall using the blocks shown in FIG. 8.

In both embodiments, the webs 4 are made of high strength plastic, or similar materials. It is important that the web 4 material be lightweight. The web 4 material may also be thermally inert (i.e., non conductive), although this is not a requirement and, in some embodiments (e.g., blocks for internal walls), may be unnecessary. For example, the web 4 may be made of lightweight metal, even though the thermal characteristics of metal are such that a relatively large amount of heat may flow through it.

B. "Specialty" Blocks

Referring now to FIGS. 9–14, a number of "speciality" blocks are shown, that have been modified from the traditional structure of the composite block. These blocks can be full height or half height, depending on the look desired. In all cases, wall assembly and block construction is similar to that described above. However, the shape of the blocks and placement of the webs has been modified.

Figure 9:
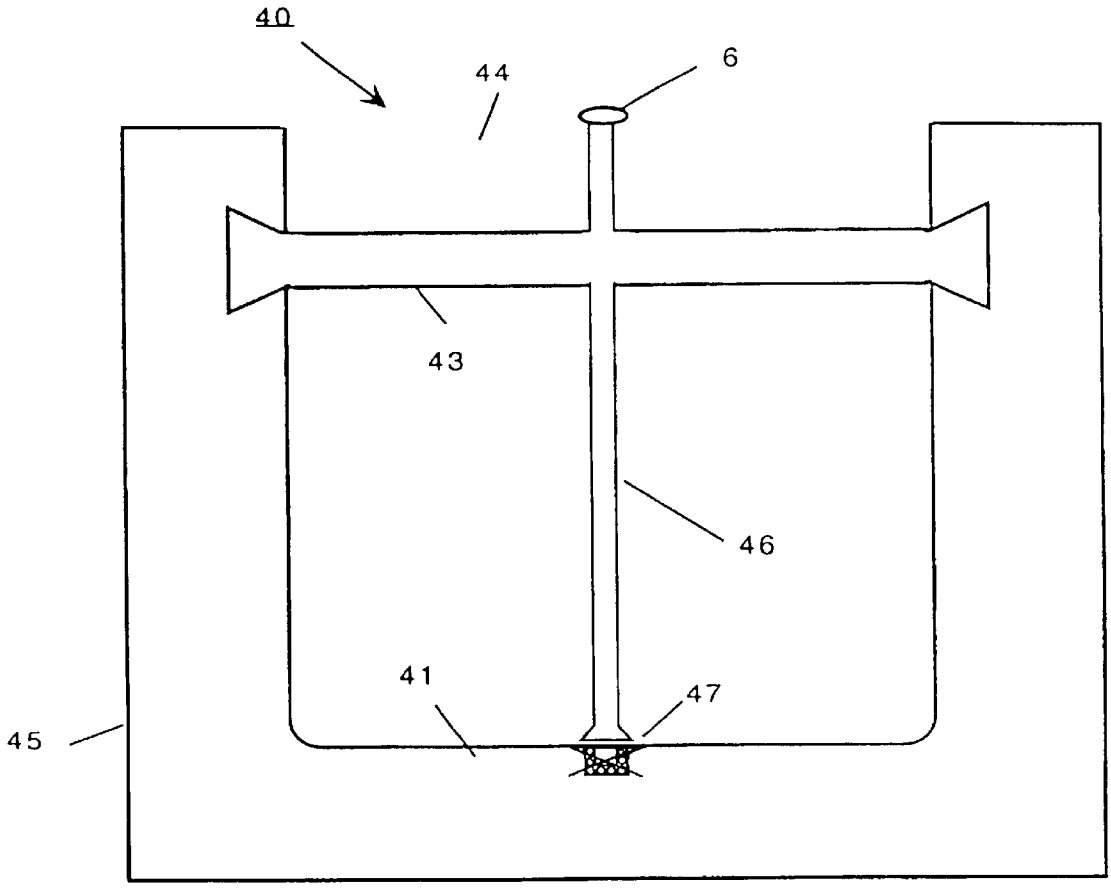
FIG. 9 is a top view of a half-length unit with a solid concrete jamb end.

FIG. 9 shows a half-length block 40 that has a solid masonry jamb end 41. As shown, the web 42 has a single arm 43, which is positioned relatively nearer the open end 44 of the block. Instead of two unconnected walls, this unit has a continuous outer wall as shown 45. The center form 46 is embedded into the masonry jamb end 41 as shown, and may be surrounded by foam insulation.

Figure 10:
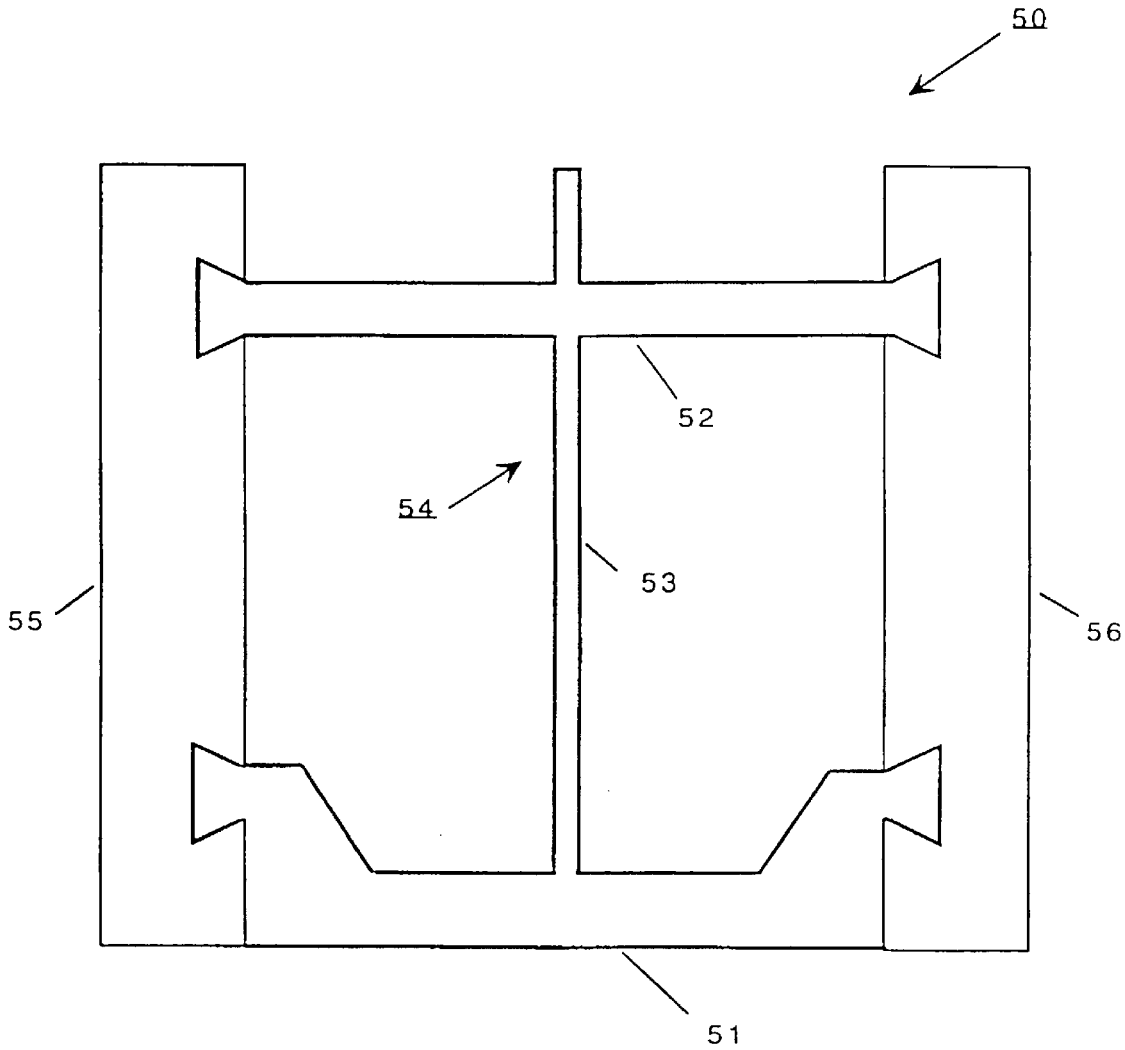
FIG. 10 is a top view of a half-length unit with a solid plastic jamb end.

FIG. 10 shows a half-length block 50 that has a solid plastic arm end 51. A second arm 52 is placed in the block as shown. A center form 53 is also provided. All the arms are connected to form a one piece web 54. Two masonry walls 55 and 56 are also provided.

Figure 11:
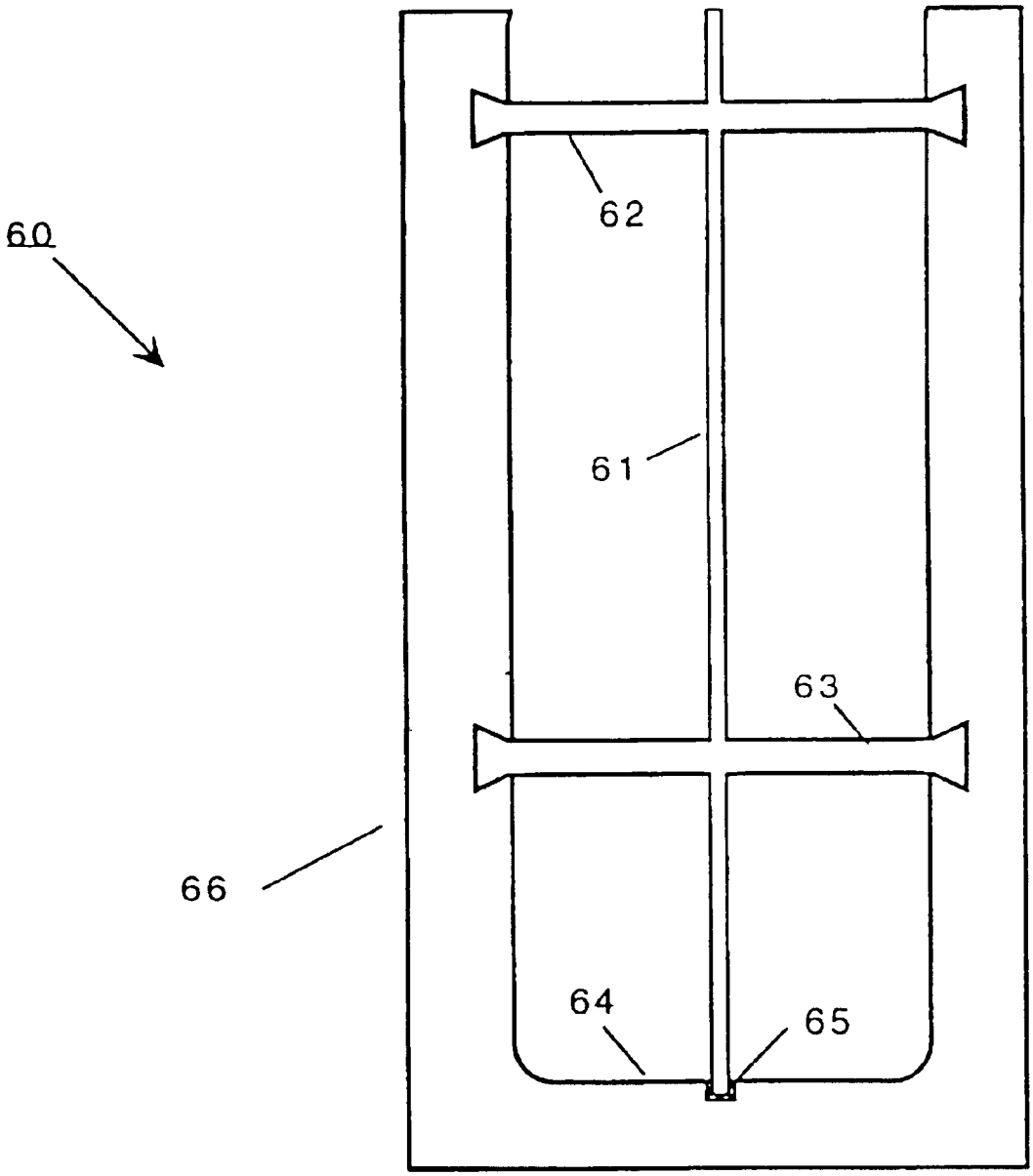
FIG. 11 is a top view of a full-length unit with a solid concrete jamb end.

FIG. 11 is a full-length version of the embodiment of FIG. 9. This block 60 has a center form 61, and two arms 62 and 63 as shown. As in the block of FIG. 9, the center form 61 is embedded into the masonry jamb end 64 as shown, and is surrounded by foam insulation 65. Here, there is a single length of masonry wall 66.

Figure 12:
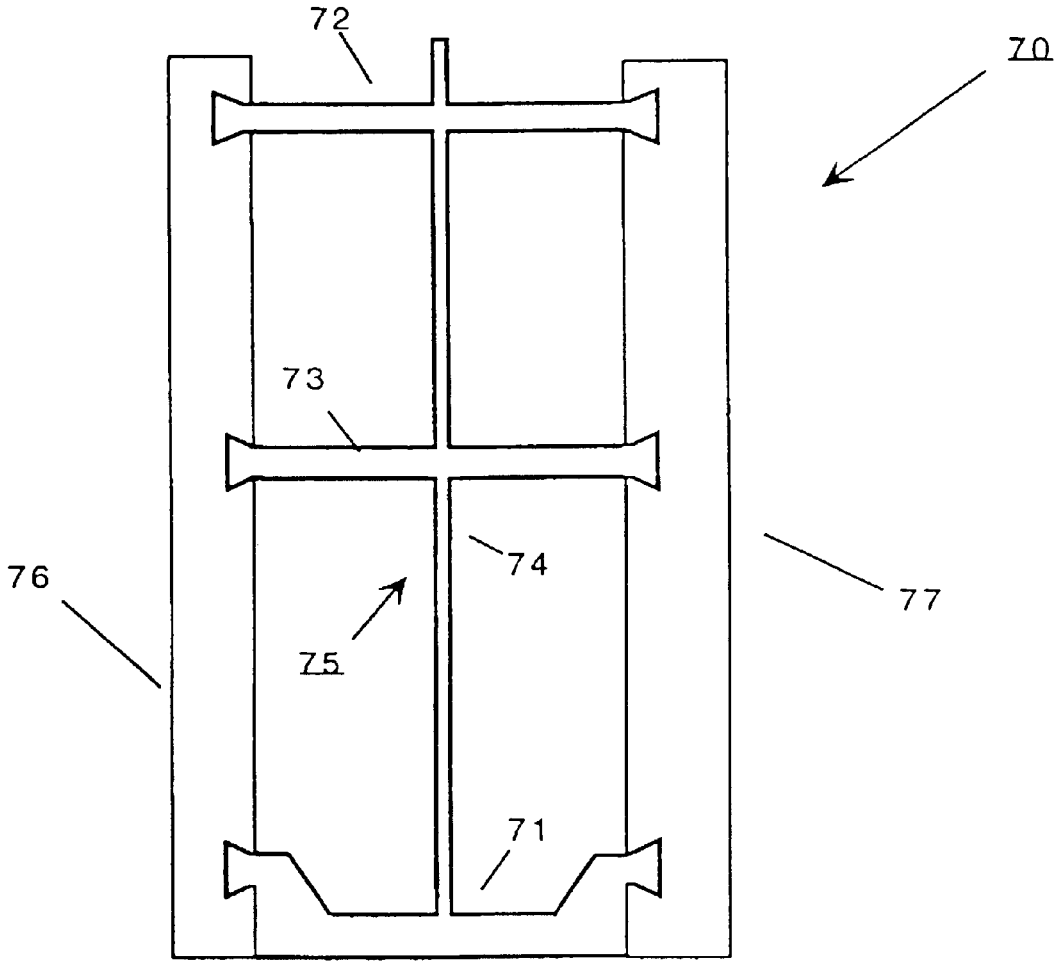
FIG. 12 is a top view of a full-length unit with a solid plastic jamb end.

FIG. 12 is a full-length version of the embodiment of FIG. 10. This block 70 has a solid plastic arm end 71. Two additional arms 72 and 73 are placed in the block as shown. A center form 74 is also provided. All the arms are connected to form a one piece web 75. Two masonry walls 76 and 77 are also provided.

Figure 13:
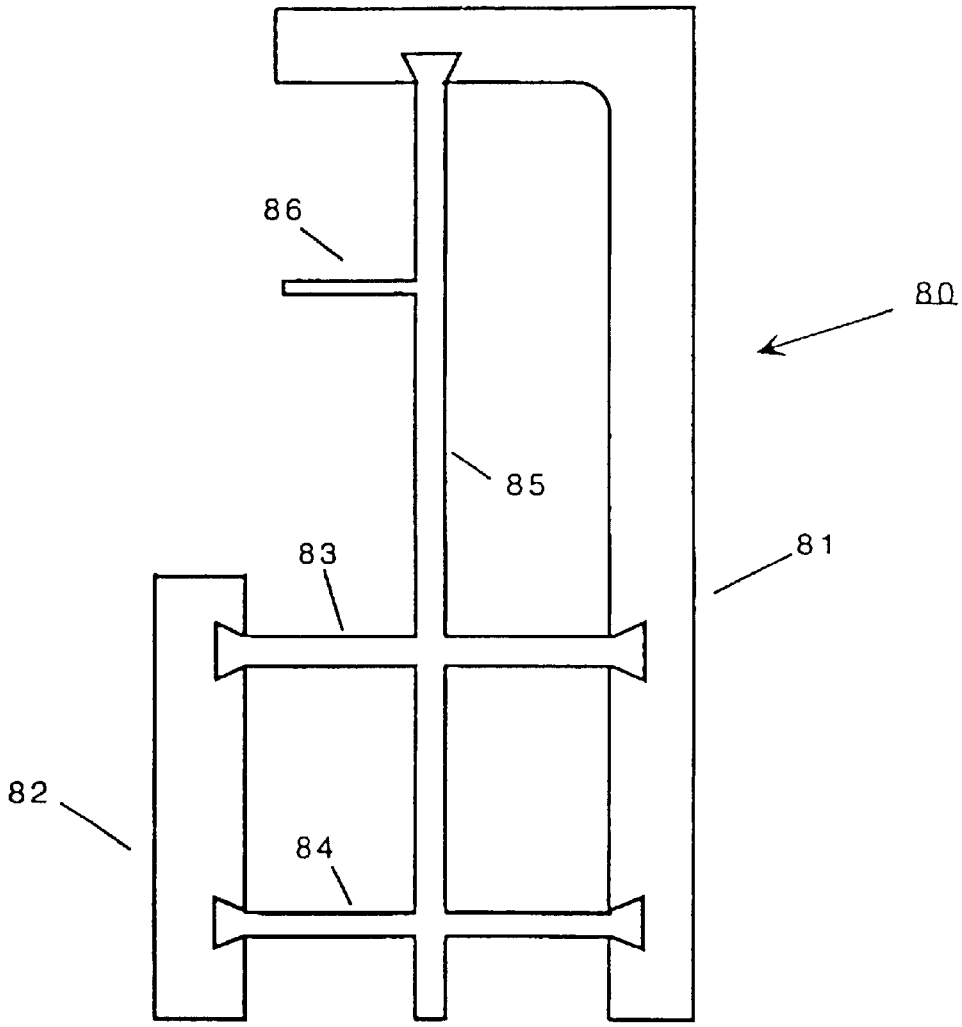
FIG. 13 is a top view of a corner unit.

FIG. 13 is a top view of a typical corner unit 80. This unit is designed to present an outer corner that preserves a stylistic surface. This block 80 has a curved outer wall 81, and a short inner wall 82. The walls 81 and 82 are connected by two arms 83 and 84. A center form 85 is configured as shown. A connector arm 86 is also provided. It extends from the center form 85 as shown. The connector arm 86 is used to connect to a wall block 1 as part of the overall wall as shown in FIG. 14.

Figure 14:
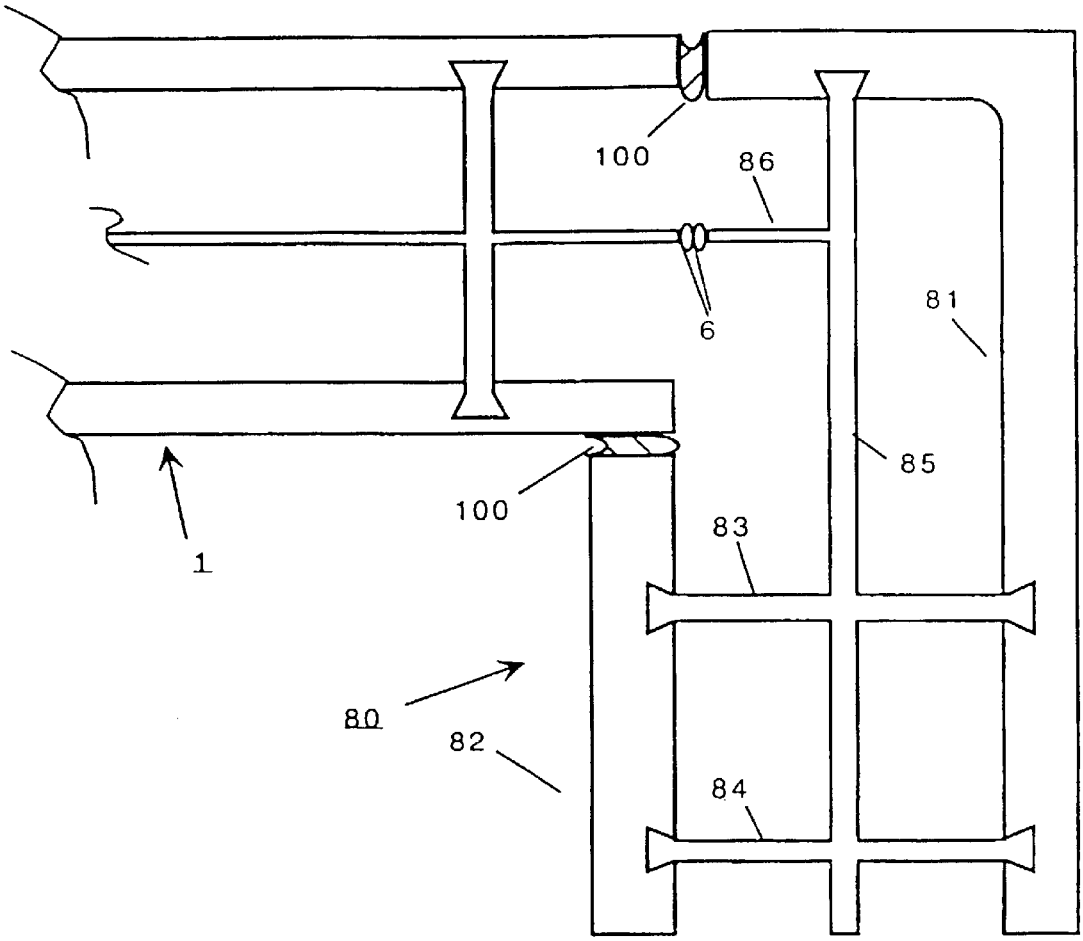
FIG. 14 is a top view of a typical corner connection.

FIG. 14 shows how the corner unit 80 is connected to a standard block 1. The placement of these blocks alternates with each course of blocks. The mortar joints 100 are placed as shown. Two foam pads 6 are provided to connect the center form 10, for example of block 1 to the connector arm 86 of the corner block 80. Of course, the corner block 80 can be made half-height to accommodate the other half-height designs.

C. Alternative Embodiments of the Composite Building Block

The use of a connective structure formed separately from the inner and outer walls and formed from a moldable material, such as ABS plastic, polypropylene, polyethylene (including any of the preceding reinforced with a strengthening material such as glass fibers or an internal wire or rod frame) or molded fiberglass, has a number of significant implications for the composite blocks and the walls formed with them. The designer of the composite block is not limited by the possibilities offered by the masonry type materials, in particular, the single batch of low slump concrete used to form a conventional concrete block.

One group of possibilities that becomes available has to do with the inner and outer walls. These can now be formed in the same equipment known and used in the art to form concrete blocks, using a different mold insert. Because the wall pieces can be made without having to create any interconnecting web at the same time, the wall pieces for more blocks can be created in one mold cycle than if the full blocks were being formed. This permits improved utilization of the block-forming equipment and associated labor. For example, it has been found that mold forming wall pieces can typically produce, in one mold cycle, twice the number of pairs (inner and outer) of wall pieces as the number of blocks that would be produced in the same single mold cycle of conventional block forming equipment.

If the wall piece pairs are not produced in the same mold cycle, it is possible to have inner and outer wall pieces that are not made of the same materials. For example, a block could be formed with an outer wall of brick and an inner wall of concrete, or vice versa. The inner and outer wall pieces may be made with different colors or one or both may be subjected to different, additional processes after forming. For example, a brick wall piece could undergo a glazing process after forming to provide a glazed brick surface for an inner or outer wall. Or a stone or other veneer could be adhered to a concrete inner or outer wall. Thus, either the inner or outer walls can be formed first as a substrate, with other surface treatments to be applied as desired.

While at least one of the inner and outer walls is load-bearing, it is not necessary that the other one be load-bearing. This is particularly the case for interior walls, where loads may be lighter. This opens up additional possibilities for the materials and finishes used. In a non-load bearing wall, the wall can include pre-formed apertures or other features that may be part of a wall design. For example, an inner or outer wall can be formed with an aperture for receiving an electrical receptacle or a protruding pipe or other electrical or mechanical element. An inner wall can be formed with airflow apertures that can be used for an HVAC system that delivers air through conduits in the wall.

The composite block opens up another set of possibilities focused on the connective structure and variations in it that are made possible by using plastic materials that are formed by injection molding, die molding, extrusion, pultrusion or other forming processes. Such materials and processes permit the formulation of three-dimensional, lattice-like connection structures consisting of various arms and webs. The lattice-like structures use little material, can be light in weight and physically occupy a relative small percentage of the total rectangular solid volume defined by the edges of the opposed inner and outer walls. These qualities permit the formation of one or more handholds for manipulating the composite block and are partly responsible for the limited thermal conduction paths between the inner and outer walls. Among the features of the connective structure that may be formed and varied are:

1. The connectors of the connective structure that are connected to the corresponding connective formations in the walls can take on a wide variety of shapes and sizes. They may penetrate into walls or attach to features extending from the surface of walls. The connectors may be formed so that several are attached to each wall, or, in an appropriate application, with a single connector of suitable size and strength for each of the inner and outer walls. The connectors can be shaped with legs or other extensions that are compressed or pried apart for insertion, depending on whether the corresponding connector formation and surrounding wall material are best suited to accept a compressive load, a tensile load or a combination. Also, in appropriate applications, the connector may be formed so as to facilitate an adhesive attachment to a wall, e.g., with an epoxy glue. Although the connective structure preferably connects to the back or interior face of each of the inner and outer walls, it may also attach to the edges of the walls or contact the outer faces.

2. A variety of handles can be formed in the connective structure, depending on the weight and size of the wall pieces, to make the composite block easier to handle by an installer. Conventional masonry construction will be facilitated when the handle allows the mason to easily grasp the composite block at or near a balance point and with the handle axis surrounded by the hand being generally perpendicular to the inner and outer walls.

3. Depending on the weight of the wall pieces, their shape, their separation in the finished composite block and the loads and forces to which the finished wall will be subjected, the arms or other members of the connective structure that carry the connectors may be made thicker or thinner and may support or receive rebar or other reinforcing structures of various kinds.

4. The portion of the connective structure that is used as a center form or partition between inner and outer walls can be made in a variety of structures. It can be placed closer to the inner wall or to the outer wall, to vary the space available for concrete and insulation that is poured into the wall after it is built. The partition can also be formed so that it is easier to join the partition pieces of vertically or horizontally adjacent block in an overlapping manner. Vertical partition overlap avoids the need for inserting any separate joint material at the upper and lower edges of the partition during wall construction.

5. The arms, webs and connectors of the connective structure can be formed so that it fits or interlocks with other materials placed between the inner and outer walls. For example, instead of using a center form or partition to permit insulation to be introduced into half of the wall cavity after construction, each discrete composite block can be assembled with a block of insulation that fits around and with the connective structure. The block of insulation has slits or channels cut in it that permit it to slide into position on the connective structure, which then serves to secure and hold the block of insulation in position between the inner and outer walls (and in alignment with the edges of the inner and outer walls).

6. The connective structure can be formed so that it has guides or raceways in it that facilitate the insertion or passage of other items that are inserted in the walls. These can include grooves in the upper portions of the connective structure formed so that they support horizontally-placed reinforcing bars. Other features that can be formed as part of the connective structure are channels or closed conduits for receiving electrical wires, fiber optic cables and the like or for carrying airflow.

7. A further possibility is integral forming of the connective structure and one of the walls. In this embodiment, the same material is used both for the internal web with its arms/webs and connectors, but connectors are only needed at one wall. At the other wall, the connective arms/webs are formed to be integral with a wall panel. The assembly of the composite block involves forming the connection between wall and connective structure at only one wall. The opposite wall, formed integrally with the connective structure, can be covered, if desired, with a variety of surface treatments or structural extensions, including masonry, tile or wood and can be made load-bearing or not, as required for the application. End panels for one or both ends of the composite block can also be integrally-formed.

8. The integrally-formed wall discussed immediately above can be formed as a smooth panel or with a variety of shapes and structures. These can be aesthetic or functional. In particular, as with the separate wall pieces discussed above, an integral inner or outer wall can be formed with an aperture for receiving an electrical receptacle or a protruding pipe or other electrical or mechanical element. An inner wall can be formed with airflow apertures that can be used for an HVAC system that delivers air through conduits in the wall. These conduits may be formed as part of the lattice.

Thus, it can be seen that the composite block presents a wide range of design possibilities that can be realized by various formed shapes for the connective structure and the walls it connects. The following describes composite blocks embodying these features in further detail.

In FIGS. 15*a–d* to 26*a–b* there are shown top and side views of several alternative embodiments of the composite building block that illustrate the present invention's versatility. Each will be briefly discussed in turn and in light of the previously described embodiments.

In FIGS. 15*a–d*, another embodiment of the connective structure or web is shown. In this embodiment, the connective structure 200 comprises a center form 210, a pair of end arms 207*a*, 207*b*, a center arm 208, and a pair of optional reinforcing arms 211*a*, 211*b* that are connected between the center form 210 and one end of the end arms 207*a*, 207*b*. In this embodiment, each arm 207*a*, 207*b*, 208 of the connective structure 200 also has a V-shaped insert-type connector 205 at the end of the arm. The legs 206 of this connector 205 may be compressed together such that it will fit in the corresponding connector formation 209 in each of the inner and outer walls 202, 203, in this case a V-shaped slot, where it will become frictionally engaged upon removal of the compression forces on the legs 206. It will be clear that the V-shape for connector 205 and corresponding connector formation 209 may be varied, with connector 205 assuming other shapes, such as semicircular, circular, square (as viewed in horizontal cross-section).

There are several interesting aspects of this embodiment of the connective structure. It can be seen from FIGS. 15*a–d* that the center arm 208 has a pair of recessed grooves 231*a*, 231*b*, although more or less than the two recessed grooves shown may be used and the location of these grooves may be varied across arm 208. These grooves may be used as horizontal retaining support for rebar (not shown) when the connective structure 200 of a block 201 is adjacent to one or more other connective structures. It can also be seen that the center arm 208 is vertically displaced on the center form 210 with respect to the end arms 207*a*, 207*b*. This displacement may make placement of rebar in the grooves relatively easier and may add to the structural integrity of the complete block unit.

Figure 15A:
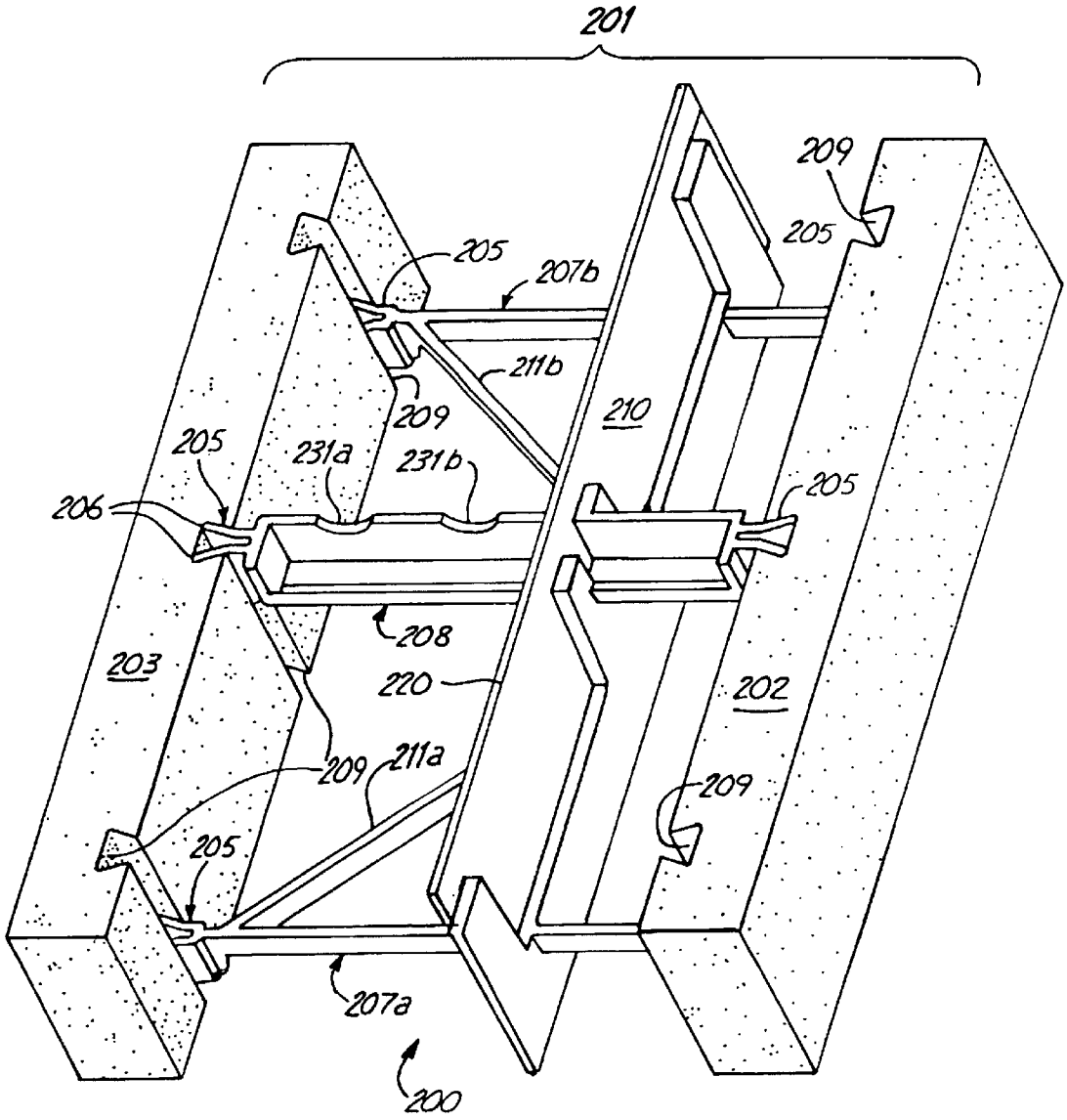
Figure 15B:
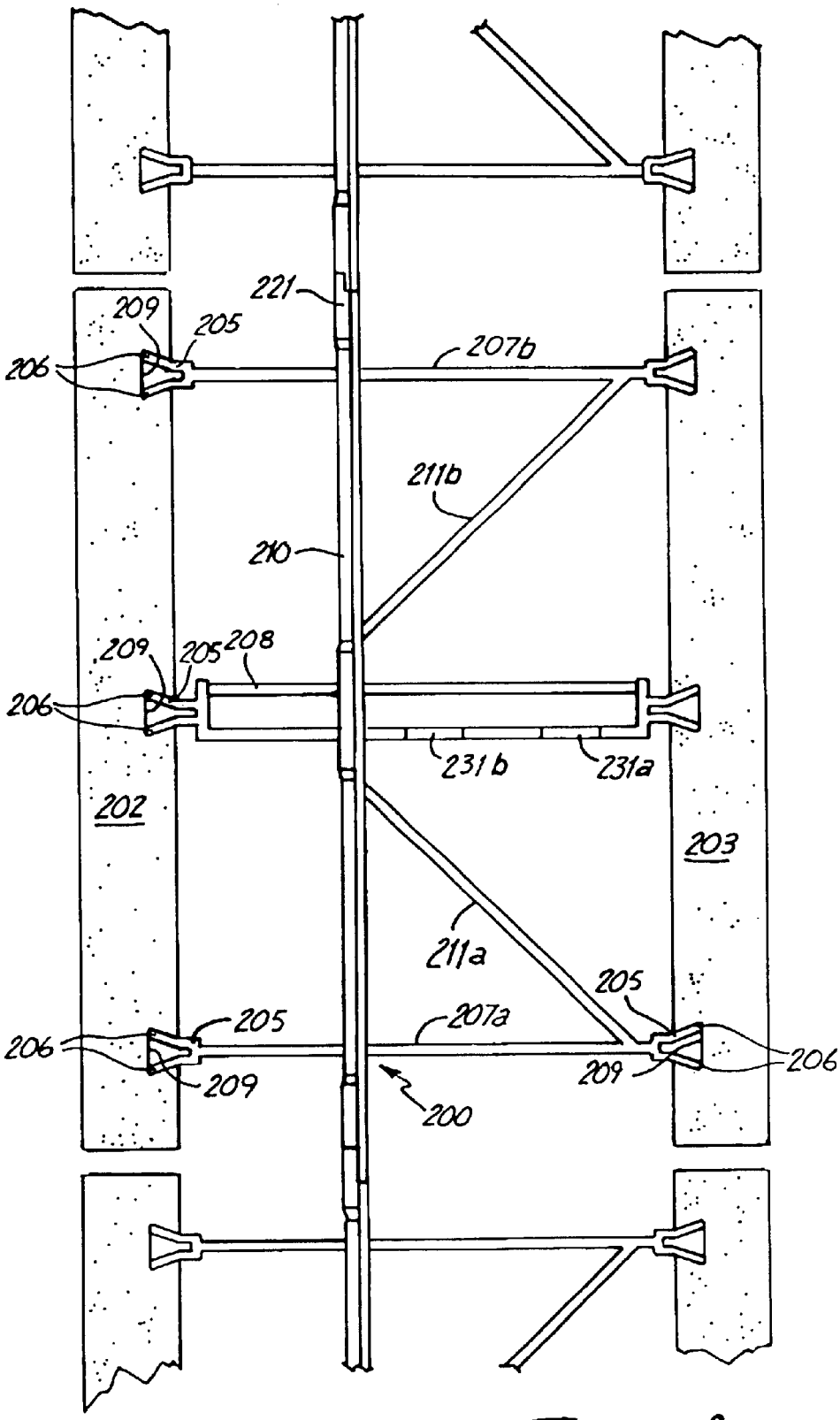
Figure 15C:
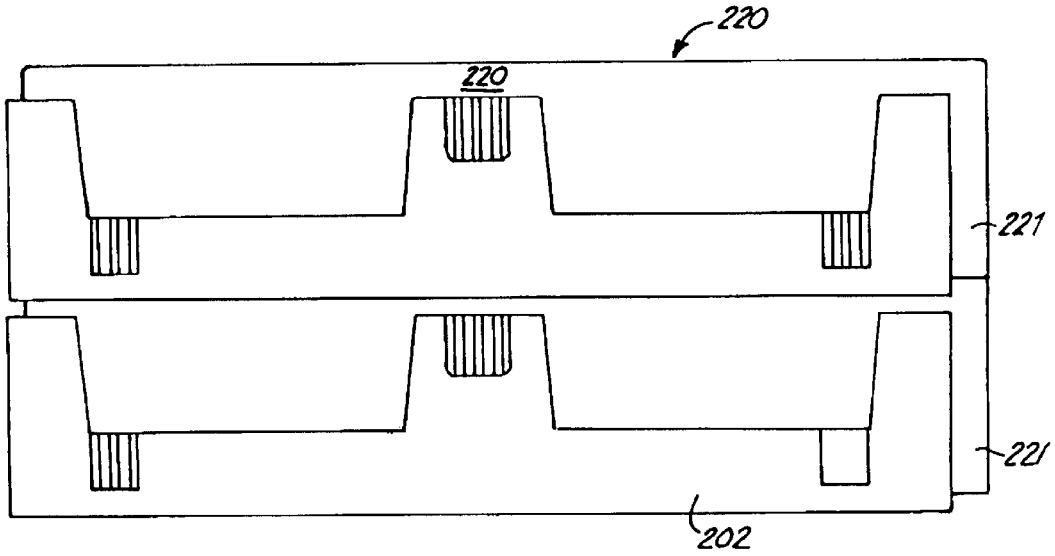
Figure 15D:
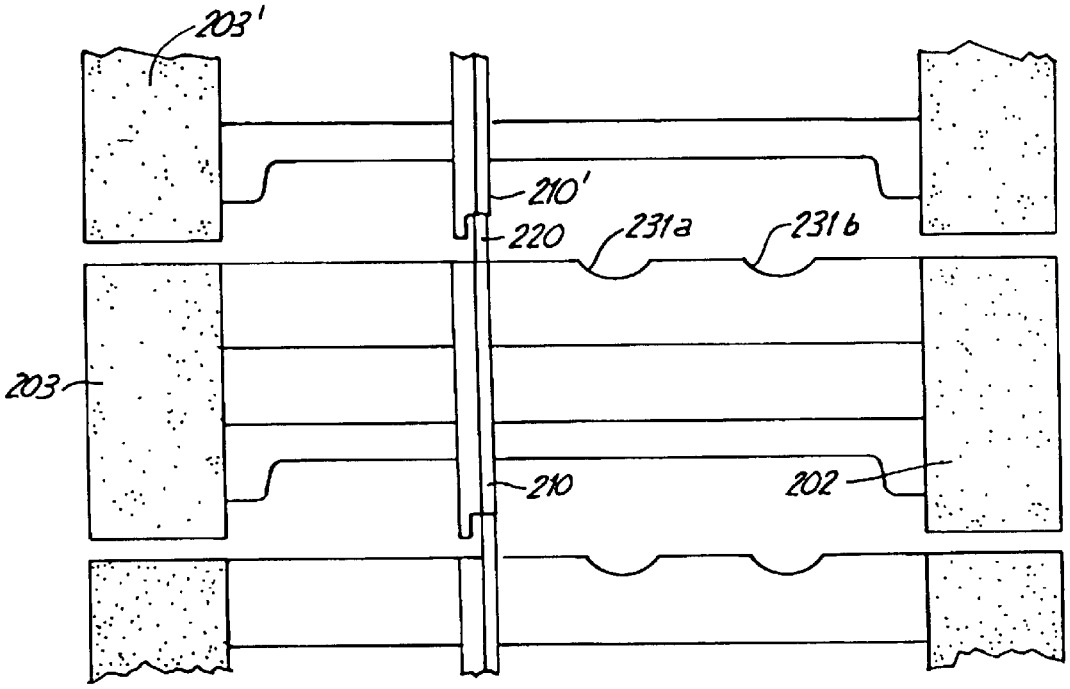

A further feature of the connective structure is an offset lip 220 along one of the upper or lower edges of the center form 210 (FIG. 15*d* shows this lip at the upper edge). This lip 220 overlaps with the adjacent edge lip of the center form of the vertically adjacent block immediately below the lip. (See FIG. 15*d*). With this structure the center partition of a wall can be formed without using the sealing material shown at 6 in FIGS. 4, 5 and 7. A similar edge lip 221 at one short edge of center form 201 provides the same sealing function with the center form of the horizontally adjacent block. (See FIGS. 15*b*, 15*c*).

The embodiment of the composite block 301 in FIGS. 16*a–b* illustrates that the relative volume of the cavities formed by the inner and outer walls 302, 303 and the center form 310 of the connective structure may be varied according to wall construction requirements by selecting the position of the center form 310 with respect to the arm or arms 307 of the connective structure 300. For example, if relatively less insulative material will be needed for the cavity formed with the inner wall 303 and/or relatively more concrete will be required for load-bearing purposes in the cavity formed with the outer wall 302, the connective structure 310 may be formed such that the length of the connector arm or arms 307 projecting from the center form 310 to the outer wall 302 is greater than the length of the arm or arms projecting from the center form 310 to the inner wall 303. In this regard, arms 311 like the reinforcing arms 211*a*, 211*b* of FIGS. 15*a–b* may be used to prevent relatively longer connector arm segments from buckling or bending, and provide added support for the system. In essence, the composite block design permits the center form 310 to serve as a selectable partition element, the position of which can be selectively varied at molding to produce different block and wall internal structures and characteristics.

In FIGS. 17*a–b*, the connective structure 400 is manufactured without the center form described in other embodiments. In this embodiment, the center form may be eliminated because the insulative material is a preformed block 410 (of plastic foam or a similar material), that fills some portion of the cavity formed by the inner and outer walls 402, 403 (in effect, acting as the center form for purposes of determining the volume of the cavity between the wall 403 and the preformed insulation block). The preformed insulation block 410 may be manufactured with appropriate grooves 411*a*, 411*b* that form fit to the connective structure 400 as shown. The block 410 is also formed with a size so that its edges are substantially in alignment with the edges of inner and outer walls 402, 403. In addition, to limit air infiltration through the insulation layer of a completed wall, one or more compressible foam strips 412 or extensions can be added to or formed with the insulation block 410 to prevent or limit gaps between insulation blocks of vertically or horizontally adjacent composite blocks. In one embodiment, the insulation block 410 may slide onto the connective structure 400 by insertion from the top or the bottom of the composite block 410, before or after the connective structure 400 joins the inner and outer walls 402, 403. For example, the composite block construction of this embodiment may be performed by form fitting a preformed block cut with straight channels onto a portion of arms 407*a*, 407*b* in the connective structure 400, and then connecting the connective structure 400 to the walls 402, 403 as described above. The connective structure 400 is formed with webs and/or arms oriented and positioned so as to ease insulation insertion and ensure stable insulation holding when the composite block is moved.

In FIGS. 18*a–b*, a simple arm embodiment of a connective structure 500 without a center form is shown. The arm 520 may simply join two walls 502, 503 where support at the center of each wall is sufficient. The arm 520 may be a dual planar web, with a handle aperture 522 and relief aperture 524, that forms cavities in a manner similar to the center form of previously described embodiments except "rotated" ninety degrees. In this embodiment, depending on the size and weight of inner and outer walls 502, 503, the size, mass, or strength of portions of the connective structure 500 and their penetration into the walls 502, 503 may need to be modified to accommodate the increased loads borne by the simple arm 520. Also note that in this embodiment, the surface of the outer wall 503 has been treated in some manner to form an outer layer 505, e.g., glazing, color layer, brick veneer. This treatment may be for functional and/or aesthetic purposes and may be done on the inner wall 502, as well. This is made possible by the composite nature of the block and the ability to apply a separate surface treatment process to a wall after its initial forming and before it is assembled into a composite block.

In FIGS. 19*a–b*, the inner wall 603, which is load bearing in other embodiments, is replaced with a thin, non load-bearing wall unit. This embodiment may be useful in a variety of construction projects, such as an interior wall when both layers of the double-layer wall are not required to be load-bearing, and secondly, when cavities between the outer and inner wall units 602, 603 are still desirable. The non-load-bearing wall 603 permits other materials, such as tile or other aesthetic finishes to be used in the composite block 601 and resulting wall. Depending on the type of non-load-bearing material employed, the connective structure 600 may need to be adapted, e.g., connectors 605 may need to be increased in number or changed in height or extent of penetration into wall 603 to provide suitable support (e.g., at edges) for a material that is fragile or subject to warping or other distortion.

FIGS. 20*a–b* and 21*a–b*, illustrate but two of a wide variety of connector structures or schemes that may be used with the present invention. In FIGS. 20*a–b*, each connector 705*a*–705*d* of the connective structure 700 is spread before engagement and encloses a portion of a wall; thus it applies compressive forces on the portion of the wall it surrounds to establish the secure connection (in contrast to previously discussed embodiments, e.g., FIG. 15*a*, where each connector would be compressed and after insertion would exert tensile forces (preferably small) on at least a portion of the wall unit where it is inserted to make the secure connection). As can be seen, each connector 705*a*–705*d* may engage a corresponding connector formation 709*a*–709*d* that extends from or is formed within the walls 702, 703. (As noted above, the connectors 705*a*–705*d* can assume a variety of other cross-sectional shapes, including semicircular, circular, square.) In FIGS. 21*a–b*, the use of resilient forces in the connection is avoided. Here, an epoxy glue, or some other adhesive substance, is utilized to join the connective structure 800 to connective formations 809 in the wall and form the composite block. Each of the projections 805 inserted into a wall is fastened by adhesive that surrounds a portion of the projection.

FIGS. 22*a*, 22*b* and 22*c* illustrate additional connection details that are possible with variations on the connective structure. In FIG. 22*a*, the connective structure 850 (shown only partially, at one wall) has a connector 855 in the form of a substantially planar web. This is inserted in a planar indentation of slightly larger dimensions formed in the inner surface of wall 852. The connector 855 is secured in place by an adhesive layer (not shown) between connector 855 and the planar indentation. In FIG. 22*b*, the connective structure 860 (shown only partially, at one wall) has a connector 865, also in the form of a substantially planar web. This is affixed to the planar inner surface of wall 862. The connector 865 is secured in place by an adhesive layer (not shown) between connector 865 and the planar inner surface of wall 862. In FIG. 22*c*, the connective structure 870 (shown only partially, at one wall) has a connector 875 in the form of a substantially planar web. This is affixed to the planar inner surface of wall 872. The connector 875 is secured in place by fasteners 877, e.g., masonry nails, that span between connector 875 and the planar inner surface of wall 872.

FIGS. 23*a* and 23*b* illustrate further connection details that are possible with further variations on the connective structure. Here the connective structure 880 (shown only partially, at one wall) engages the opposed top and bottom edges of a wall 882. (It could equally well engage a pair of side edges.) In FIGS. 23*a* and 23*b*, the connective structure 880 has a connector flange 887 with multiple connector projections 885 that are inserted for friction fit (adhesive connection is also possible) at the top edge of wall 882. A similar, mirror image structure engages the lower edge of wall 882. In FIGS. 24*a* and 24*b*, the connective structure 890 (shown only partially, at one wall) engages the opposed top and bottom edges of a wall 892. (It could equally well engage a pair of side edges.) In FIGS. 24*a* and 24*b*, the connective structure 890 has a connector flange 897 with multiple connector fingers 895 that span for friction fit (adhesive connection is also possible) the top edge of wall 892. A similar, mirror image structure engages the lower edge of wall 892.

It is clear that a wide variety of connective structures, mechanisms, methods or schemes may be used to connect and secure the connective structure to the inner and outer walls, including, without limitation, latches, pins, various male-female friction connection schemes, adhesives, and various other compression fit and friction engaging schemes. Additionally, more than one connector type could be used on the same wall unit, on the different arms of a connective structure, or even on opposite ends of the same arm.

In FIGS. 25*a–b*, the connective structure 900 and one of the outer or inner walls 903 have been combined into one integrally formed unit. This embodiment may be useful when the outer or inner wall, as the case may be, has special utilitarian requirements not easily formed in masonry material. For example, in the embodiment shown in FIGS. 25*a–b*, the outer wall 903 is formed with air apertures 910 and an opening 912 for an electrical receptacle. Such utilities are difficult to incorporate into conventional concrete block wall units. With the plastic material used to form the connective structure 900, an integral wall surface can be created with a variety of shapes (including enclosed passageways 920, 922) and openings to control air flow or receive inserted mechanical or electrical elements.

In FIGS. 26*a–b*, the connective structure 950 comprises two spaced-apart center forms 960, 962 that form yet a third cavity between the outer and inner walls 952, 953. Any cavity may be filled with various construction materials used for airflow or as a passage for wires, pipes, etc., as desired.

D. Remarks

It will be readily apparent to those skilled in the art that innumerable variations, modifications, applications, and extensions of these embodiments and principles can be made without departing from the principles and spirit of the invention. For example, it is clear that the teachings of any one embodiment may be applied to any other embodiment—e.g., the variable cavity size concepts of the embodiment shown in FIGS. 16*a–b* may be applied to the embodiment shown in FIGS. 15*a–d* or FIGS. 19*a–b*. Accordingly, it is intended that the scope of the invention be only limited as necessitated by the accompanying claims.

What is claimed is:

1. A discrete, preassembled, composite block unit for independent placement as a unit with other laterally and vertically adjacent units to form a mortared wall structure, comprising:

a first wall and a second wall, at least one of which is load bearing for vertical loads and made from a first, masonry-type material, each said wall having at least one mortar receiving surface for forming a mortar joint with said adjacent block units; and a connective structure formed of a second, non-masonry-type material and connected between the first and second walls, said connective structure having at least two connectors;

wherein each of the connectors is connected to one of the first and second walls, such that prior to placement of the block unit in a wall structure the first and second walls are securely positioned with respect to one another as opposite faces of a discrete, substantially rectangular block, each face having a face area;

wherein the connective structure is free of direct, structural connection to any wall of each adjacent block unit when the block unit is in a wall structure;

wherein the connective structure comprises arms supporting the at least two connectors and said arms provide a thermal conduction path of limited vertical cross-sectional area relative to either wall face area; and wherein the connective structure comprises:

a center form with first and second opposed sides;

at least one of the arms supporting a connector projects outwardly from each of the opposed sides of the center form; and wherein the arms taper such that the vertical cross-sectional area of the connective structure decreases as it extends away from the walls toward the center form.

2. The block unit of claim 1, wherein at least one connector is an insert-type connector and one of the first and second walls has a connector formation that is matingly engaged by the connector.

3. The block unit of claim 2, wherein the connector formation is a receptacle and the insert-type connector is inserted into the receptacle, such that the insert-type connector is frictionally engaged by the receptacle.

4. The block unit of claim 1, wherein each of the connectors is matingly engaged in one of the first and second walls.

5. The block unit of claim 1, wherein the connective structure is substantially composed of a plastic material.

6. The block unit of claim 1, wherein the center form comprises a partition that forms a first cavity with the first wall and a second cavity with the second wall.

7. The block unit of claim 6, wherein the first cavity is larger than the second cavity.

8. The block unit of claim 1, wherein at least one connector has sides extending outwardly and is received in a dovetail-shaped connector formation in the first or second wall.

9. A discrete, preassembled, composite block unit for independent placement as a unit with other laterally and vertically adjacent units to form a mortared wall structure, comprising:

a first wall and a second wall, at least one of which is load bearing for vertical loads and made from a first, masonry-type material, each said wall having at least one mortar receiving surface for forming a mortar joint with said adjacent block units; and a connective structure formed of a second, non-masonry-type material and connected between the first and second walls, said connective structure having at least two connectors;

wherein each of the connectors is connected to one of the first and second walls, such that prior to placement of the block unit in a wall structure the first and second walls are securely positioned with respect to one another as opposite faces of a discrete, substantially rectangular block, each face having a face area;

wherein the connective structure is free of direct, structural connection to any wall of each adjacent block unit when the block unit is in a wall structure;

wherein the connective structure comprises arms supporting the at least two connectors and said arms provide a thermal conduction path of limited vertical cross-sectional area relative to either wall face area; and wherein the first wall and second wall each have an upper edge when connected by the connective structure and the arms of the connective structure comprise:

two end arms and a center arm;

wherein the center arm is vertically displaced with respect to the end arms to a position nearer the said upper edges of the first wall and second wall.

10. The block unit of claim 9, wherein the center arm comprises at least one recess for accommodating a horizontal reinforcing bar.

11. The block unit of claim 9, wherein the connective structure further comprises a center form supported on the two end arms and center arm.

12. The block unit of claim 9, wherein the top of the center arm is flush with the top of the first and second walls.

13. A discrete block unit as claimed in claim 9 further comprising an insulating mass having approximately the same height and width dimensions as the first and second walls, said mass being secured and held by the connective structure so as to provide a barrier to energy movement between the first and second walls.

14. A discrete block unit as claimed in claim 9 wherein at least one of the first wall and the second wall has a surface treatment.

15. A discrete block unit as claimed in claim 9 wherein at least one of the first and second walls is unitary with the connective structure.

16. A discrete, preassembled, composite block unit for independent placement as a unit with other laterally and vertically adjacent units to form a mortared wall structure, comprising:

a first wall and a second wall, at least one of which is load bearing for vertical loads and made from a first, masonry-type material, each said wall having at least one mortar receiving surface for forming a mortar joint with said adjacent block units; and a connective structure formed of a second, non-masonry-type material and connected between the first and second walls, said connective structure having at least two connectors and a center form having one side facing the first wall and one side facing the second wall;

wherein each of the connectors is connected to one of the first and second walls, such that prior to placement of the block unit in a wall structure the first and second walls are securely positioned with respect to one another as opposite faces of a discrete, substantially rectangular block, each face having a face area;

wherein the connective structure is free of direct, structural connection to any wall of each adjacent block unit when the block unit is in a wall structure;

wherein the connective structure comprises arms supporting the at least two connectors and said arms provide a thermal conduction path of limited vertical cross-sectional area relative to either wall face area; and wherein at least one arm projects from either side of the center form, wherein each at least one arm has a connector, and wherein the projection length of the at least one arm is not equal to the projection of the other at least one arm.

17. A connective structure for forming a discrete, preassembled, composite block unit for independent placement as a unit mortared with other laterally and vertically adjacent units to form a mortared, masonry wall structure, each block unit having a first wall and a second wall, each with a face area and at least one of which is load-bearing for vertical loads, comprising:

a plurality of elements forming arms and connectors for connecting the connective structure between the first wall and the second wall, the elements comprising: a center form; two end arms projecting outwardly from each side of the center form and substantially perpendicularly from the center form, wherein both ends of each end arm have a connector; a center arm projecting outwardly from each side of the center form and substantially perpendicularly from the center form, wherein both ends of the center arm have a connector; wherein the arms extend between the first and second walls and each connector is a compressible element for insertion into and frictional engagement with one of said first and second walls to securely position said walls with respect to one another as opposed faces;

wherein the connective structure is a non-masonry material and is free of direct, structural connection to any wall of each adjacent block unit when the block unit is in a wall structure;

wherein said at least one arm provides a thermal conduction path of limited vertical cross-sectional area relative to either face area; and wherein the connective structure is integrally formed of a substantially rigid material.

18. The connective structure of claim 17, wherein at least one of the connectors is an insert-type connector for a dovetail-shaped connector formation in the first or second wall.

19. The connective structure of claim 18, wherein the insert-type connector is generally V-shaped.

20. The connective structure of claim 17, wherein the arms supporting the at least two connectors taper such that the vertical cross-sectional area of the connective structure decreases as it extends away from the connectors.

* * * * *